US008075088B2

(12) United States Patent
Kawashima et al.

(10) Patent No.: US 8,075,088 B2
(45) Date of Patent: Dec. 13, 2011

(54) IMAGE FORMING APPARATUS

(75) Inventors: Yasuhiro Kawashima, Kanagawa (JP); Taku Kudoh, Kanagawa (JP); Masaru Watanabe, Tokyo (JP); Hideki Sueoka, Tokyo (JP); Ikoh Soh, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 975 days.

(21) Appl. No.: 12/030,009

(22) Filed: Feb. 12, 2008

(65) Prior Publication Data

US 2008/0231653 A1 Sep. 25, 2008

(30) Foreign Application Priority Data

Mar. 19, 2007 (JP) ..... 2007-071118

(51) Int. Cl.
*B41J 2/165* (2006.01)

(52) U.S. Cl. ..... 347/29; 347/42

(58) Field of Classification Search ..... 347/8, 9, 347/29, 49

See application file for complete search history.

(56) References Cited

U.S. PATENT DOCUMENTS

| | | | | |
|---|---|---|---|---|
| 5,344,248 | A * | 9/1994 | Schoon et al. | 400/693 |
| 5,530,463 | A * | 6/1996 | Nystrom et al. | 347/44 |
| 5,719,610 | A * | 2/1998 | Scheffelin | 347/86 |
| 5,988,787 | A * | 11/1999 | Watanabe et al. | 347/22 |
| 6,250,736 | B1 * | 6/2001 | Wojcik | 347/33 |
| 6,328,492 | B1 * | 12/2001 | McKay et al. | 400/656 |
| 6,530,644 | B2 * | 3/2003 | Premnath et al. | 347/35 |
| 6,984,017 | B1 * | 1/2006 | Berry et al. | 347/29 |
| 7,077,495 | B2 | 7/2006 | Kawashima | |
| 2002/0018084 | A1 * | 2/2002 | Shiida et al. | 347/8 |
| 2003/0076376 | A1 * | 4/2003 | Greeven et al. | 347/29 |
| 2003/0156153 | A1 * | 8/2003 | Ishikawa | 347/29 |
| 2004/0008235 | A1 * | 1/2004 | Keyes et al. | 347/29 |
| 2004/0227785 | A1 * | 11/2004 | Katsuta et al. | 347/33 |
| 2005/0104827 | A1 | 5/2005 | Kudoh et al. | |
| 2005/0146554 | A1 | 7/2005 | Asanuma et al | |
| 2005/0194730 | A1 | 9/2005 | Nishida et al. | |
| 2006/0119655 | A1 * | 6/2006 | Berry et al. | 347/32 |
| 2006/0170740 | A1 * | 8/2006 | Nakamura | 347/85 |
| 2006/0214958 | A1 * | 9/2006 | Inoue | 347/5 |
| 2007/0171253 | A1 | 7/2007 | Kudoh et al. | |

FOREIGN PATENT DOCUMENTS

| | | |
|---|---|---|
| JP | 4-16344 | 3/1992 |
| JP | 6-297722 | 10/1994 |
| JP | 2810701 | 7/1998 |
| JP | 2000-263801 | 9/2000 |
| JP | 2000-301710 | 10/2000 |
| JP | 2004-142365 | 5/2004 |
| JP | 2005-178246 | 7/2005 |
| JP | 2006-123203 | 5/2006 |
| JP | 2006-123301 | 5/2006 |

* cited by examiner

*Primary Examiner* — Charlie Peng
*Assistant Examiner* — Peter Radkowski
(74) *Attorney, Agent, or Firm* — Cooper & Dunham LLP

(57) ABSTRACT

A disclosed image forming apparatus includes an apparatus main body; a page-width inkjet head unit capable of ejecting fluid droplets without substantially moving the page-width inkjet head unit while forming an image on a medium to be recorded on; a maintaining and recovering unit maintaining and recovering a function of a nozzle of the page-width inkjet head unit; and an engaging unit for engaging the page-width inkjet head unit and the maintaining and recovering unit together as a single unit when the page-width inkjet head unit and the maintaining and recovering unit are removed from the apparatus main body as a single unit.

20 Claims, 20 Drawing Sheets

IMAGE FORMING APPARATUS

BACKGROUND

1. Technical Field

This disclosure generally relates to an image processing apparatus including a line recording head staying in the same position when ejecting fluid droplets to form an image.

2. Description of the Related Art

As an image forming apparatus such as a printer, a facsimile apparatus, a copy machine, and a complex machine, there is known an inkjet recording device employing a liquid ejection recording method using a recording head ejecting droplets of recording fluid. In the liquid ejection recording method used in an image forming apparatus, recording fluid such as an ink droplet is ejected onto a sheet being conveyed (Note: the term a "sheet" is not limited to a "paper" but may include any medium such as an OHP sheet to which fluid such as an ink droplet can be attached; and the term "sheet" may be called "medium to be recorded", "recording medium", "recording paper", "recording sheet", and the like.) for forming an image on the sheet (Note: regarding the term "forming", terms "recording", "typing", "imaging", and "printing" may be used as synonyms). As the image forming apparatus employing the liquid ejection recording method, there are a serial-type image forming apparatus having a recording head moving in the main scanning direction and ejecting fluid droplets to form an image, and a line-type image recording apparatus having a recording head ejecting fluid droplets to form an image without substantially moving the position of the recording head relative to the apparatus main body.

As one of the line-type image recording apparatuses, Japanese Patent Application Publication No. 2004-142365, discloses an apparatus in which a head unit including an inkjet head is removably mounted on a main body of the apparatus so that the head unit can be extracted from the main body. Further, a recording device maintenance kit for maintaining and recovering (restoring) the functions of the head unit is removably mounted on the extractable head unit.

Further, according to Japanese Patent Application Publication No. 2006-123301, an apparatus includes a supporting axle supporting plural recording heads ejecting ink droplets onto a recording medium; a head moving mechanism rotating the recording heads so as to move between an image recording area and an evacuating area other than the image recording area; and a nozzle recovering unit performing a nozzle recovering operation for at least one of the recording heads in the evacuating area while one of the recording heads is forming an image in the image recording area.

Still further, according to Japanese Patent Application Publication NO. 2000-263801, an apparatus includes a capping and wiping member integrally having a capping part disposed so as to cap a surface on which nozzles of a recording head are formed; a cleaning part disposed so as to wipe a conveying surface of a conveying unit; and a positioning mechanism section positioning the capping and wiping member at a first position between the surface and the conveying unit and at a second position as a waiting position separated from the first position.

Still further, according to Japanese Patent Application Publication No. H04-16344, an apparatus includes a supporting member having a supporting unit to which a line recording head section is removably attached; and a guiding unit moving the guide member to a capping position to cap the recording head section, a recording position, and a maintenance position.

In addition, Japanese Patent Application Publication Nos. 2006-123203 and 2005-178246 disclose each apparatus in this technical field.

However, generally, a line recording head is equipped with more nozzles than any other shorter recording head. Because of this feature, unfortunately, a line recording head is more likely to cause mal-ejection such as curved ejection in which ejected droplets are curved and the inability to eject ink droplets in a worst case. To solve the problem, a maintaining and recovering mechanism (unit or device) is usually provided in the apparatus to maintain and recover the functions of nozzles. However, even with such a maintaining and recovering mechanism, it is still difficult to always keep the nozzles in a normal ejecting condition. Therefore, the recording head of the apparatus should be replaceable.

However, during the replacement of a line recording head, there is a problem that recording fluid (hereinafter simply referred to as "ink") stored in the head may leak from the nozzles of the line recording head, thereby contaminating the inside of the apparatus.

SUMMARY

In an aspect of this disclosure, there is provided an image processing apparatus capable of having the line recording head easily replaced.

In another aspect of this disclosure, there is provided an image forming apparatus including an apparatus main body; a page-width inkjet head unit capable of ejecting fluid droplets without substantially moving the position of the page-width inkjet head unit while forming an image on a medium to be recorded; and a maintaining and recovering unit maintaining and recovering a function of the nozzles of the page-width inkjet head unit, wherein the page-width inkjet head unit and the maintaining and recovering unit are removably mounted on the apparatus main body as a single unit.

According to another aspect, the image forming apparatus further includes a fluid tank mounted on the page-width inkjet head unit, wherein the page-width inkjet head unit and the fluid tank are removably mounted on the apparatus main body as a single unit.

According to still another aspect, the image forming apparatus further includes a waste tank storing waste fluid that is useless for forming an image, wherein the waste tank can be mounted on the maintaining and recovering unit.

According to still another aspect, the page-width inkjet head unit is movably disposed in upward/downward directions; and either the page-width inkjet head unit or the maintaining and recovering unit includes an engaging unit for engaging the page-width inkjet head unit with the maintaining and recovering unit as a single unit when the page-width inkjet head unit is lowered.

According to still another aspect, the page-width inkjet head unit is movably disposed in upward/downward directions; and the maintaining and recovering unit includes a cap unit for sealing the page-width inkjet head unit, and an engaging unit for engaging the page-width inkjet head unit with the maintaining and recovering unit as a single unit, the engaging unit being disposed at a position lower than a first position where the page-width inkjet head unit is first in contact with the cap unit when the position of the page-width inkjet head unit is lowered.

According to still another aspect, the page-width inkjet head unit is horizontally movably disposed so as to move between an image forming position for forming an image and an evacuating position separated from the image forming position; and the page-width inkjet head unit includes an engaging unit for engaging the page-width inkjet head unit with the maintaining and recovering unit as a single unit when the page-width inkjet head unit is in the evacuating position.

According to still another aspect, the image forming apparatus further includes a fluid tank for storing fluid to be supplied to the page-width inkjet head unit; and an open/close valve disposed in the page-width inkjet head unit for opening/closing a fluid supply channel between the fluid tank and the page-width inkjet head unit, wherein the open/close valve is closed when the page-width inkjet head unit is separated from the apparatus main body.

According to still another aspect, the page-width inkjet head unit is a page-width inkjet head unit structure including a head section capable of ejecting fluid droplets of plural colors; the page-width inkjet head unit structure is horizontally movably disposed so as to move between an image forming position for forming an image and an evacuating position separated from the image forming position; and the maintaining and recovering unit faces the page-width inkjet head unit structure when the page-width inkjet head unit structure is in the evacuating position.

According to still another aspect, the image forming apparatus further includes a rotation axle, wherein the page-width inkjet head unit structure includes a head supporting section mounted on the rotation axle, and a head section removably mounted on the head supporting section. Further, the head section and the head supporting section each have a first connector section enabling the connection and disconnection of a fluid supply channel between the head section and the head supporting section. Still further, the first connector section includes a valve mechanism for opening and closing the fluid supply channel. Still further, the head section and the head supporting section each have a second connector section enabling the connection and disconnection of an electrical signal transmission channel between the head section and the head supporting section.

According to still another aspect, the head section and the head supporting section each have a positioning unit for determining the positional relationship between the head section and the head supporting section. Further, the head section includes a handle attached thereon. Still further, the evacuating position of the page-width inkjet head unit structure is located on the front side of the apparatus main body.

According to still another aspect, the image forming apparatus further includes a conveying belt structure including a conveying belt for conveying a recording medium to be recorded on, wherein the page-width inkjet head unit structure is rotatably mounted on the rotation axle; and either the maintaining and recovering unit or the conveying belt structure is positioned relative to and is mounted on the rotation axle.

According to still another aspect, the image forming apparatus further includes a height adjusting unit for adjusting the height of the page-width inkjet head unit structure.

According to still another aspect, the image forming apparatus further including a conveying unit for conveying a medium to be recorded on; an interval determining unit for determining an interval between the page-width inkjet head unit structure and the conveying unit; and a height determining unit for determining the height of the maintaining and recovering unit and the page-width inkjet head unit structure when the page-width inkjet head unit structure is in waiting or maintenance and recovery operations.

According to still another aspect, the image forming apparatus further includes a first positioning unit for positioning the head section so that the longitudinal direction of the head section is substantially orthogonal to the conveying direction of a medium to be recorded on; and a second positioning unit for positioning the head section relative to the maintaining and recovering unit.

According to still another aspect, the image forming apparatus further includes first detecting units disposed one on each of upstream and downstream sides relative to the page-width inkjet head unit structure in the conveying direction of a medium to be recorded on; and second detecting units for determining whether the page-width inkjet head unit structure is in the image forming position or the evacuating position.

In an image recording apparatus according to an exemplary embodiment, a line recording head is mounted on the maintaining and recovering unit as a single unit and the single unit is removably mounted on the apparatus main body. Because of this structure, it is possible to remove the line recording head along with the maintaining and recovering unit from the apparatus main body. Further, when ink in the line recording head leaks from the nozzle, the ink is contained in the maintaining and recovering unit, thereby facilitating the replacement of the line recording head without contaminating the inside of the apparatus.

DETAILED DESCRIPTION OF THE PREFERRED EMBODIMENTS

Figure 1:
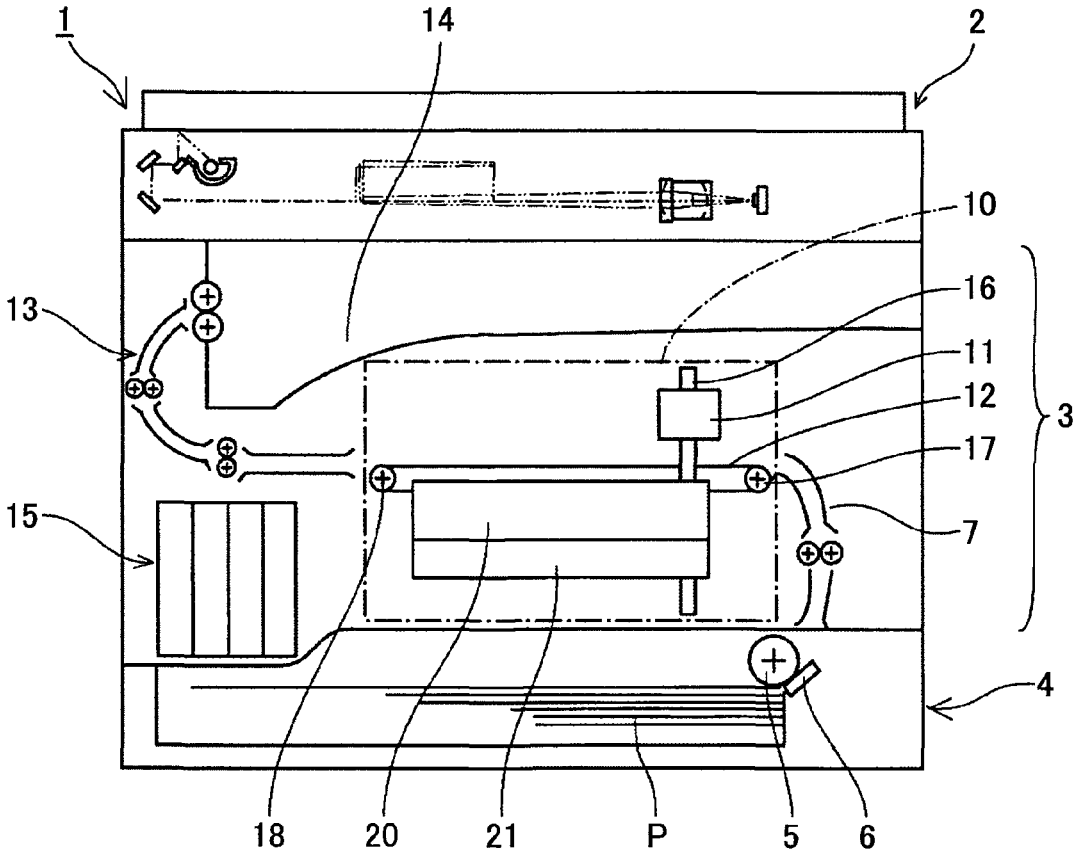
FIG. 1 is a schematic drawing showing the entire configuration of an image processing apparatus according to a first embodiment of the present invention.
Figure 2:
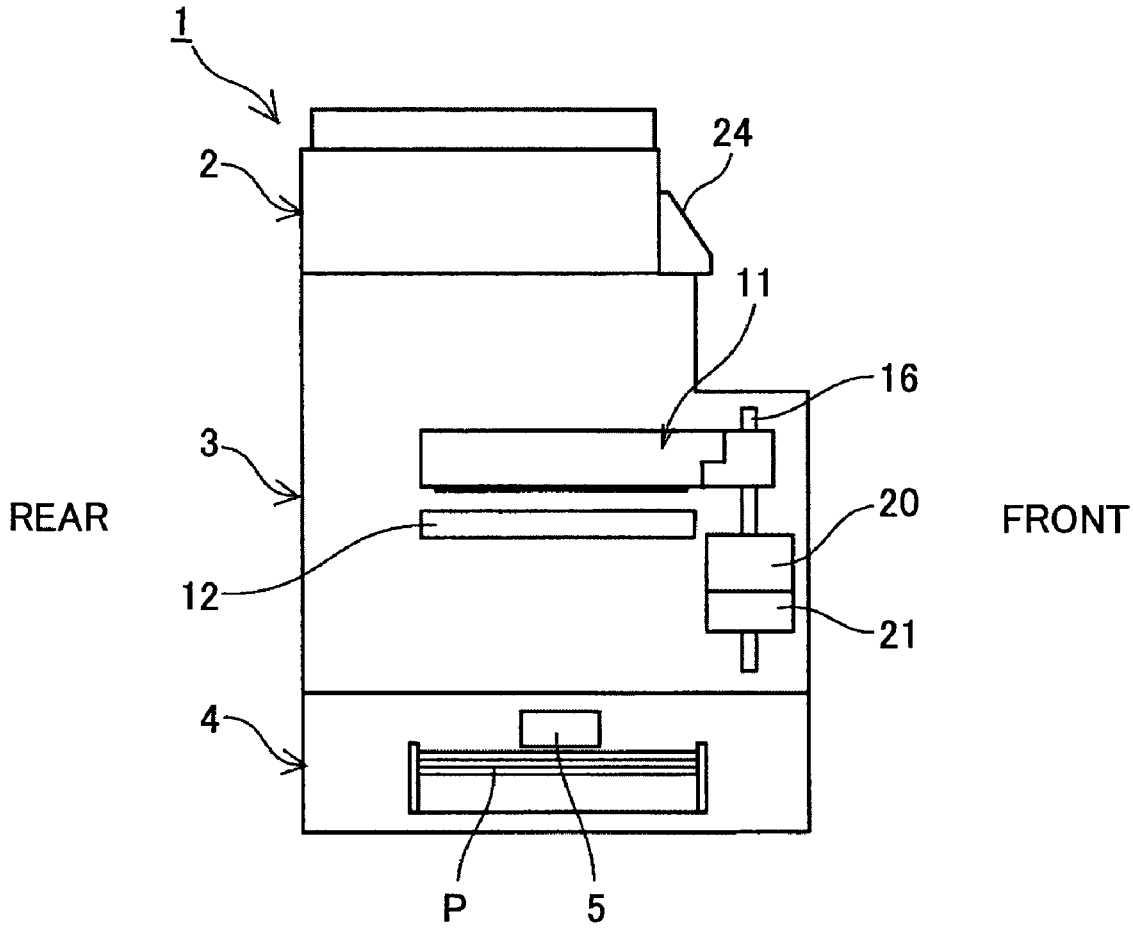
FIG. 2 is a side view of the image forming apparatus in FIG. 1 where a page-width inkjet head unit structure is located at an image forming position.
Figure 3:
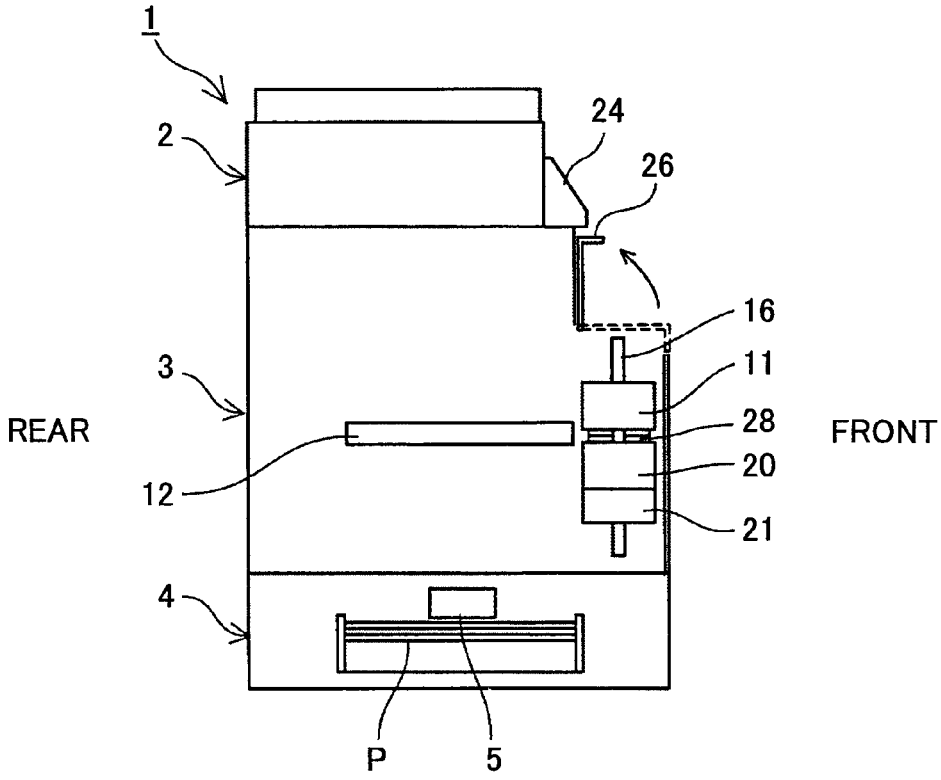
FIG. 3 is a side view of the image forming apparatus in FIG. 1 where the page-width inkjet head unit structure is in an evacuating position.

In the following, embodiments of the present invention are described with reference to the accompanying drawings. First, an exemplary image forming apparatus according to a first embodiment of the present invention is described with reference to FIGS. 1 through 3. More specifically, FIG. 1 shows a schematic configuration of the entire image forming apparatus. FIG. 2 is a side view of the image forming apparatus of FIG. 1 when a page-width inkjet head unit structure is in an image forming position. FIG. 3 is another side view of the image forming apparatus of FIG. 1 when the page-width inkjet head unit structure is in an evacuating position.

This image forming apparatus is a copy machine and includes an apparatus main body 1, an image reading section 2 for reading a draft image by, for example, scanning, and a recording section 3 for forming the image onto a recording medium to be printed on (hereinafter referred to as "a recording paper") "P".

In the image forming apparatus, recording papers "P" stored in a recording paper cassette 4 are sequentially separated by a sheet feeding roller 5 and a separation pad 6 and the separated recording paper is fed sheet by sheet to a printing section 10 through a conveying channel 7. The printing section 10 includes a page-width inkjet head unit structure 11 having a head section with a line recording head thereon, and a conveying belt 12 rotatably stretched around a driving roller 17 and an idler roller 18 for attracting and feeding the recording paper "P" by, for example, electrostatic attraction. Ink droplets are ejected from the line recording head mounted on the page-width inkjet head unit structure 11 onto the recording paper "P" attracted to the conveying belt 12 and conveyed at a prescribed speed to form an image on the recording paper "P". Next, the recording paper "P" with the formed image is discharged into a discharged paper stack section 14 through a discharging channel 13 to be stacked.

Ink is supplied from an ink cartridge 15 removably mounted on the apparatus main body 1 to the head section of the page-width inkjet head unit structure 11 in the printing section 10 though an ink tube (not shown). The page-width inkjet head unit structure 11 is horizontally rotatably mounted on a rotation axle 16. The page-width inkjet head unit structure 11 can be moved to an image forming position when an image is being formed on the recording paper "P" on the conveying belt 12 and an evacuating position when in waiting or maintenance and recovery operations. The image forming position is located on the upstream side of the conveying belt 12 as shown in FIG. 2 and the evacuating position faces a maintenance and recovery mechanism section (maintaining and recovering unit) 20. As shown in FIG. 2, there is a waste tank 21 which is ejected or suctioned from the page-width inkjet head unit and is not used for forming an image and generated in the maintenance and recovery mechanism section 20. Both the maintenance and recovery mechanism section 20 and the waste tank 21 are located in an area other than conveying area of the conveyer belt 12 for conveying the recording paper "P" and on the front side of the apparatus main body 1 so as to correspond to the page-width inkjet head unit structure 11 when it is in the evacuating position.

Further, there is an operations section 24 on the front side of the apparatus main body 1 so that an operator can operate the apparatus. As shown in FIG. 3, there is an openable and closable cover 26 on the top of the protruding section of the apparatus main body 1 below the operations section 24. The cover 26 is opened when the maintenance and recovery mechanism section 20 and the waste tank 21 are being integrally mounted on or detached from the recording section 3 of the apparatus main body 1.

Further, as shown in FIG. 3, the page-width inkjet head unit structure 11, the maintenance and recovery mechanism section 20 and the waste tank 21 together are removably mounted on the recording section 3 of the apparatus main body 1 as a single unit, the details of which are described below. The position where the page-width inkjet head unit structure 11 is mounted on and detached from the apparatus main body 1 is where the page-width inkjet head unit structure 11 faces the maintenance and recovery mechanism section 20, namely, on the front side of the apparatus body 1. Because of the position where the page-width inkjet head unit structure 11 is removably attached, the page-width inkjet head unit structure 11 can be replaced easily.

Figure 4:
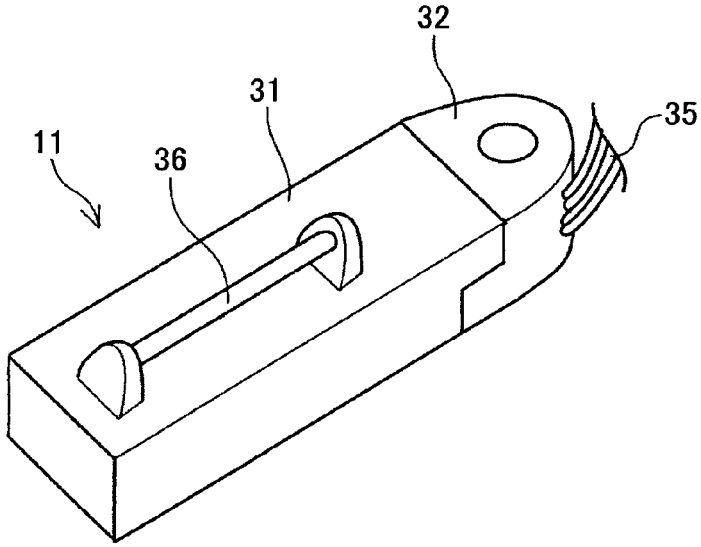
FIG. 4 is a perspective view showing the page-width inkjet head unit structure according the first embodiment of the present invention.
Figure 5:
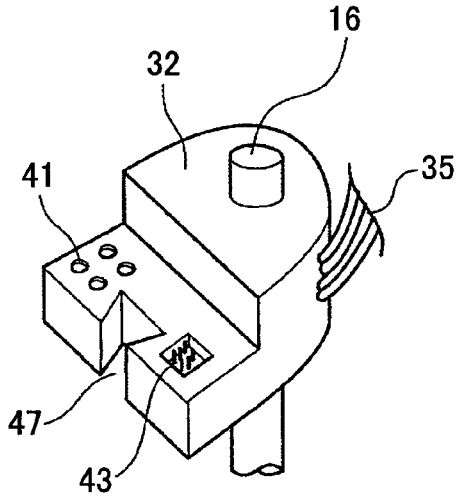
FIG. 5 is a perspective view showing a head supporting section of the page-width inkjet head unit structure in FIG. 4.
Figure 6:
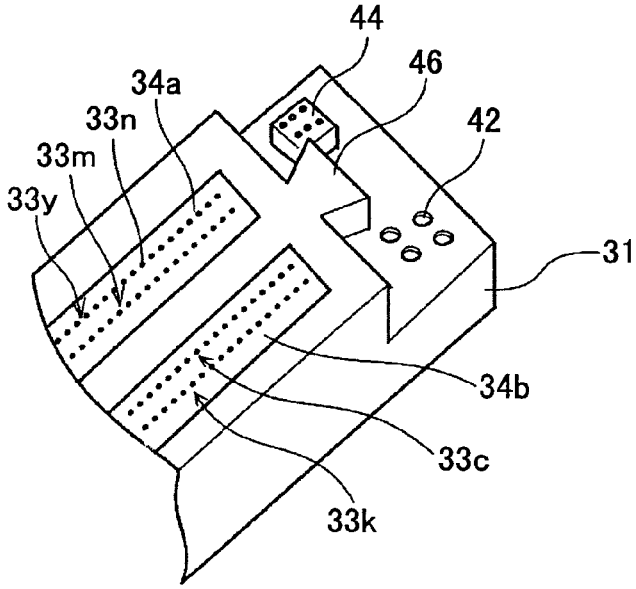
FIG. 6 is a perspective view showing a head section of the page-width inkjet head unit structure in FIG. 4.

Next, details of the page-width inkjet head unit structure 11 are described with reference to FIGS. 4 through 6. More specifically, FIG. 4 is a perspective view of the page-width inkjet head unit structure 11; FIG. 5 is a perspective view of a head supporting section 32 of the page-width inkjet head unit structure 11; and FIG. 6 is a perspective view of a head section 31 of the page-width inkjet head unit structure 11.

As shown in FIG. 4, the page-width inkjet head unit structure 11 includes the head section 31 and the head supporting section 32. The head section 31 is removably mounted on the head supporting section 32. As shown in FIG. 6, the head section 31 includes plural nozzles 33*n* consisting of, for example, nozzles 33*y*, 33*m*, 33*c*, and 33*k* that eject yellow (Y), magenta (M), cyan (C), and black (K) ink droplets, respectively (hereinafter simply referred to as "33*n*" when no specific color is necessary to be described, and this notation also applies to the other elements of the apparatus).

In this embodiment, the nozzle lines 33*y* and 33*m* are formed on a nozzle plate 34*a* and the nozzle lines 33*c* and 33*k* are formed on a nozzle plate 34*b*. However, it should be noted that the arrangement of the nozzle lines according to the present invention is not limited to this arrangement. For example, a required number of the nozzle lines may be formed on a single line plate. In addition, in this embodiment, each nozzle line 33 has substantially the same length as that of the width of a medium to be recorded on (recording paper "P"). However, it should be noted that the formation of the nozzle lines according to the present invention is not limited to this configuration. For example, plural colors of nozzles may be arranged in the same nozzle line, or plural head blocks (head arrays) may be used.

As shown in FIG. 5, ink tubes 35 from the ink cartridge 15 are connected to the head supporting section 32. Further, a signal transmission unit (not shown) is connected to the head supporting section 32. The signal transmission unit transmits signals from a control section (not shown) to drive an energy generating unit (not shown) generating energy to eject fluid droplets from the nozzles in the head section 31.

Further, as shown in FIGS. 5 and 6, the head supporting section 32 and the head section 31 include flow channel connector sections 41 and 42, respectively, for connecting and disconnecting the corresponding fluid supply channels, that is, ink channels and electronic connector sections 43 and 44, respectively, for connecting and disconnecting electronic signal transmission channels. Because of this structure, when the head section 31 is mounted on the head supporting section 32, the flow channel connector sections 41 and 42 are connected to each other, allowing ink supplied from the ink cartridge 15 to flow to the head section 31. Also, by connecting the electronic connector sections 43 and 44 to each other, the signal transmission channels are established, thereby making it possible to drive the head section 31 by using a control section (not shown).

Further, as shown in FIG. 4, the head section 31 is equipped with a handle 36. By pulling up the handle 36, the head section 31 can be easily removed from the head supporting section 32. Further, as shown in FIGS. 5 and 6, the head section 31 and the head supporting section 32 include a convex part 46 and concave part 47 (or a concave part 46 and a convex part 47), respectively. As a result, the head section 31 and the head supporting section 32 are removably mounted on each other and the relative positions of the head section 31 and the head supporting section 32 are determined by the convex part 46 and concave part 47.

Figure 7A:
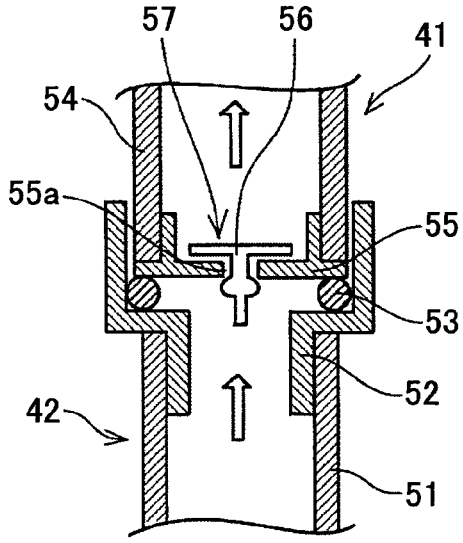
FIGS. 7A and 7B are cut-open views of an exemplary flow channel connector section of the page-width inkjet head unit structure according to the first embodiment of the present invention.
Figure 7B:
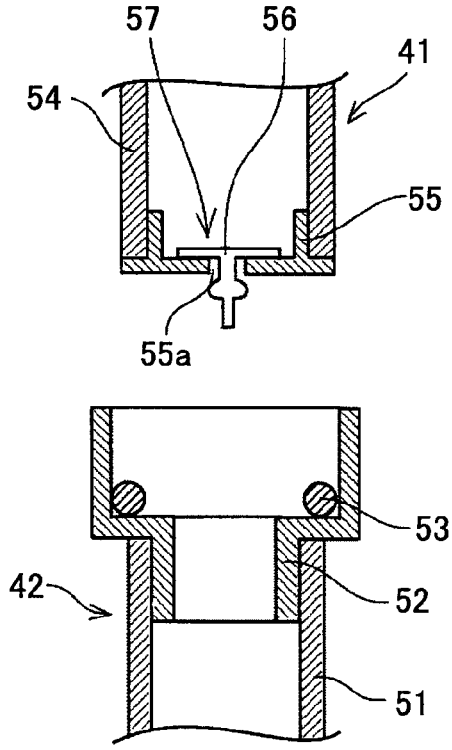

Next, one example of the flow channel connector sections 41 and 42 is described with reference to FIGS. 7A and 7B. FIGS. 7A and 7B are enlarged cut-open views of the connecting part of the flow channel connector sections 41 and 42. The head supporting section 32 includes a tube 51, a joint section 52, and a ring-shaped member 53 such as an O-ring. On the other hand, the head section 31 includes a joint section 54 capable of being removably mounted on the joint section 52, a cover member 55 used also as a valve sheet disposed on the head side of the joint section 54, an opening 55*a* formed in the cover member 55, and a check valve 57 having a valve body 56 for opening and closing the opening 55*a*.

Because of this structure, as shown in FIG. 7A, when ink is likely to flow upward from the tube 51 of the head supporting section 32 in the arrow direction in FIG. 7A, pressure is applied upward on the valve body 56 of the check valve 57. As a result, the pressure moves the valve body 56 upward so that the valve body 56 is separated from the opening 55*a* of the cover member 55 to generate a gap (to open the valve). Therefore, the ink flows toward the joint section 54 of the head section 31 so that the ink is supplied to the head section 31. Conversely, when ink is likely to flow downward from the head section 31 to the head supporting section 32, pressure is applied downward on the valve body 56 of the check valve 57 so that the valve body 56 is tightly pressed onto the cover member 55 to close the valve. As a result, the ink is prevented from flowing downward. Therefore, as shown in FIG. 7B, it is possible to prevent the leakage of ink from the head section 31 when the head section 31 is removed from the head supporting section 32.

Figure 8A:
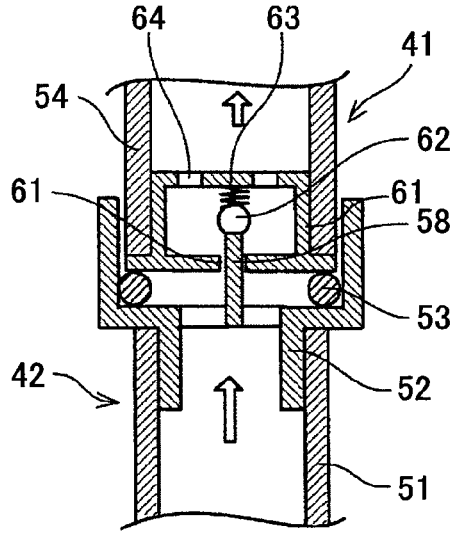
FIGS. 8A and 8B are cut-open views of an another exemplary flow channel connector of the page-width inkjet head unit structure according to the first embodiment of the present invention.
Figure 8B:
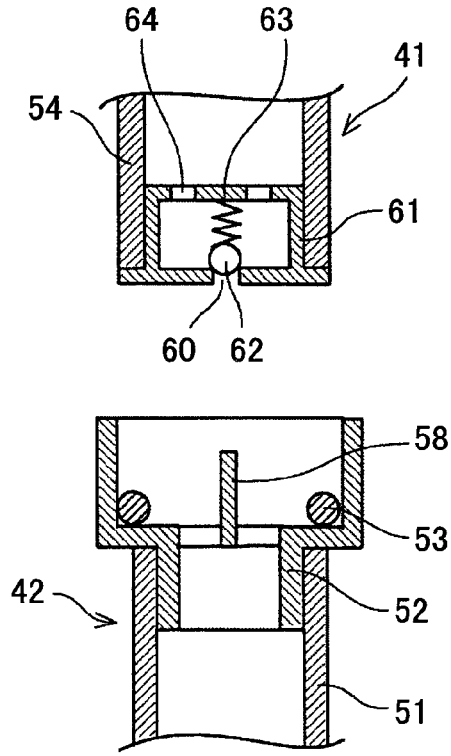

Next, another example of the flow channel connector sections 41 and 42 is described with reference to FIGS. 8A and 8B. FIGS. 8A and 8B are enlarged cut-open views of the connecting part of the flow channel connector sections 41 and 42.

The head supporting section 32 includes the tube 51, a joint section 52, a ring-shaped member 53 such as an O-ring, and a protruding part 58 in the center part of the joint section 52. On the other hand, the head section 31 includes a cover member 61 with a hole (opening) 60 formed through a bottom of the cover member 61 so as to allow the protruding part 58 of the head support section 32 to move freely through the hole 60 to the head section 31 side of the joint section 54. The head section 31 further includes a ball 62 and a spring 63. The ball 62 is disposed between the top of the protruding section 58 of the head supporting section 32 and the inner surface of a top of the cover member 61 to be used as a valve body capable of closing the hole 60. The spring 63 is connected between the ball 62 and the inner surface of the top of the cover member 61 so as to bias the ball 62 downward to the protruding part 58. Further, flow channels 64 are formed through the top of the cover member 61.

As shown in FIG. 8A, when head section 31 is mounted on the head supporting section 32, the protruding section 58 of the head supporting section 32 is moved upward against the spring force of the spring 63 so as to move the ball 62 upward to open the hole 60. Therefore, the ink flows toward the joint section 54 of the head section 31 so that the ink is supplied to the head section 31. Conversely, as shown in FIG. 8B, when the head section 31 is removed from the head supporting section 32, the ball is pressed onto the hole 60 by the spring force generated by the spring 63 to close the hole 60. Therefore, when the head section 31 is removed from the head supporting section 32, it is possible to prevent the ink from leaking to the outside.

Figure 9:
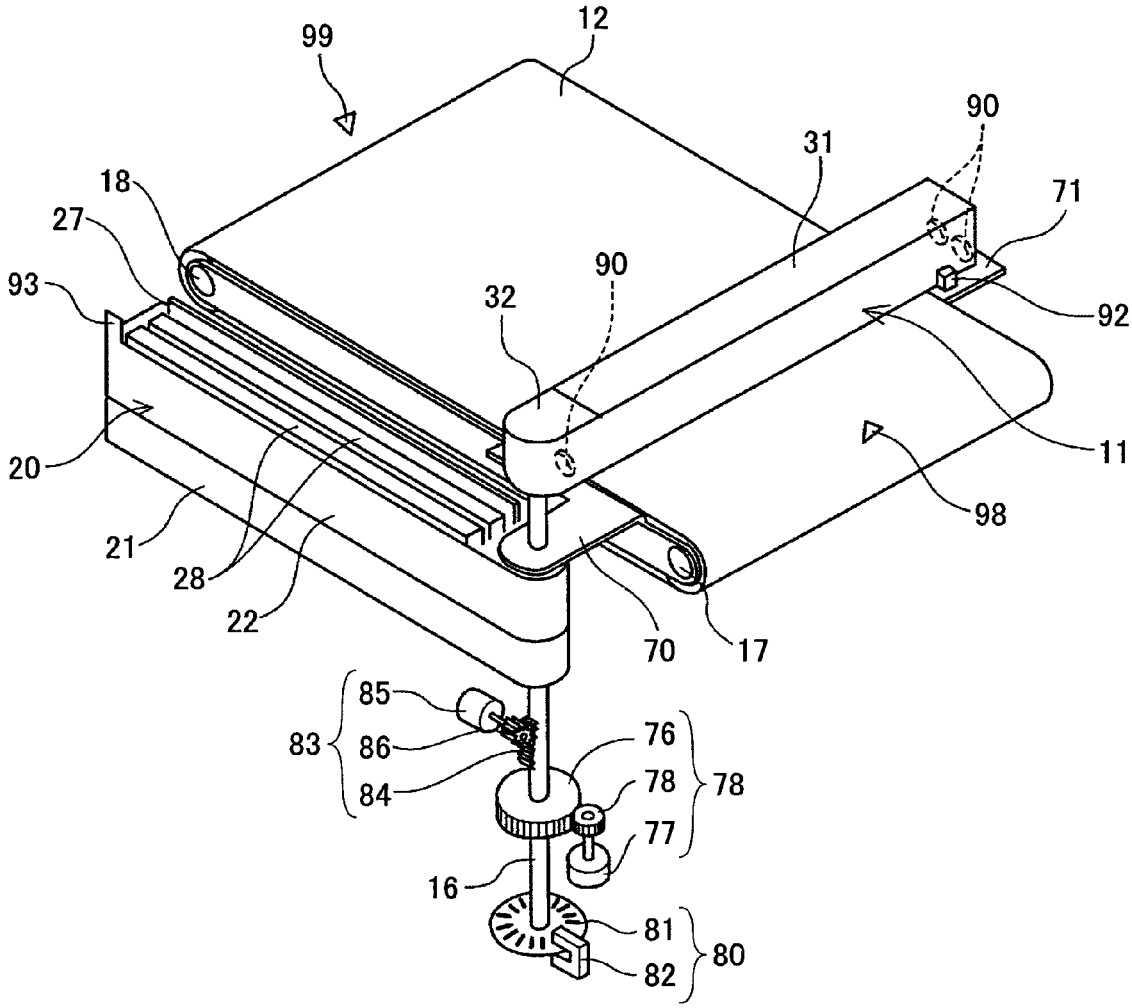
FIG. 9 is a perspective view illustrating the relative parts of a head rotation driving mechanism and a positioning mechanism according to the first embodiment of the present invention.
Figure 10:
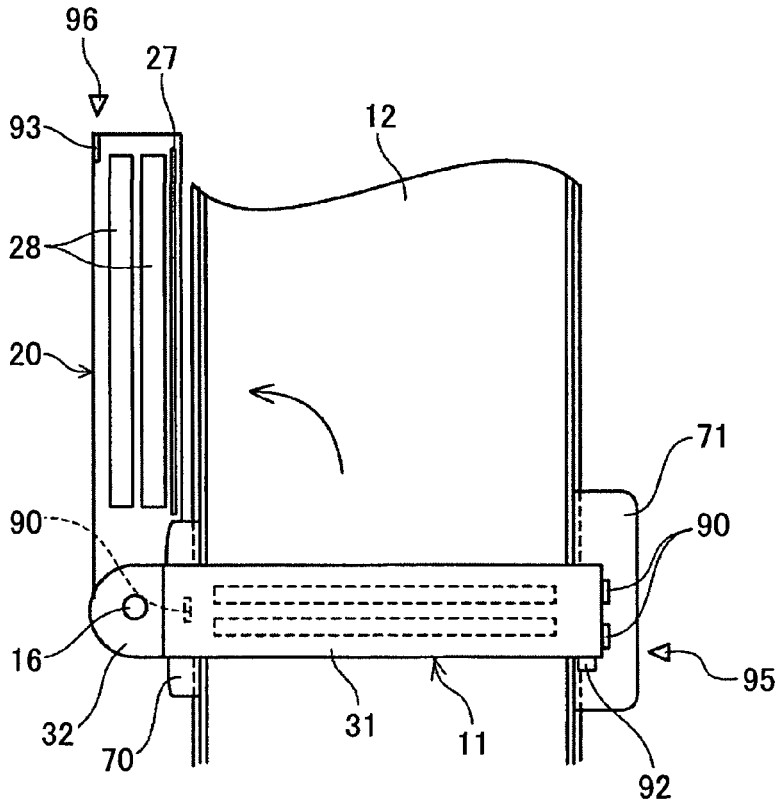
FIG. 10 is a top view of the relevant parts in FIG. 9.
Figure 11:
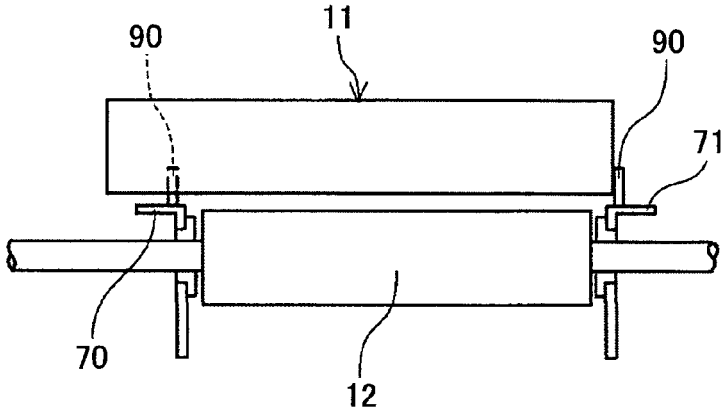
FIG. 11 is a side view of the relevant parts in FIG. 10.
Figure 12:
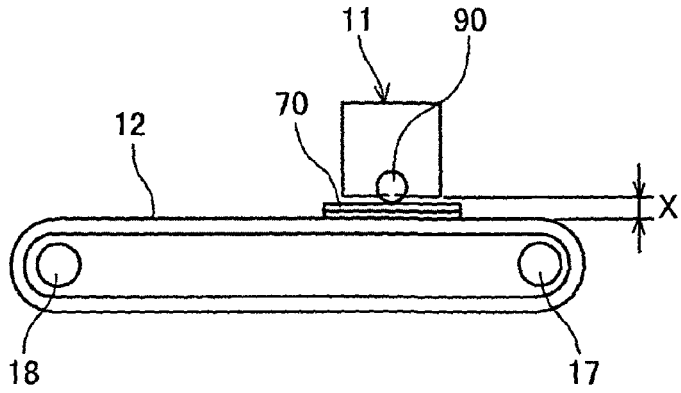
FIG. 12 is another side view of the relevant parts in FIG. 10.

Next, a driving mechanism and a position determining mechanism for the page-width inkjet head unit structure 11 are described with reference to the FIGS. 9 though 12. More specifically, FIGS. 9 and 10 are a perspective view and a top view, respectively, of a relevant part in the recording section 3. FIGS. 11 and 12 are a front view and a side view, respectively, of the part shown in FIG. 10.

First, referring to FIG. 9, the head supporting section 32 of the page-width inkjet head unit structure 11, a side plate 70 included in a belt structure rotatably holding the conveying belt 12, and a frame 22 of the maintenance and recovery mechanism section 20 are separately mounted on the rotation axle 16 so as to mutually positioned with respect to each other. Because of this arrangement, it is possible to accurately keep the positional relationships among the page-width inkjet head unit structure 11, the conveying belt 12, and the maintenance and recovery mechanism section 20.

It should be noted that the head supporting section 32 of the page-width inkjet head unit structure 11 is mounted on and fixed to the top portion of the rotation axle 16 so that the head supporting section 32 rotates in accordance with the rotation of the rotation axle 16. On the other hand, both the side plate 70 supporting the position of the conveying belt 12 and the frame 22 of the maintenance and recovery mechanism section 20 are arranged so as not to rotate with the rotation axle 16, that is, the rotation axle 16 rotates relative to the side plate 70 and the frame 22. To rotate the page-width inkjet head unit structure 11 by rotating the rotation axle, there is a head rotation driving mechanism 75 mounted on the rotation axle 16 as shown in FIG. 9. The head rotation driving mechanism 75 includes a first gear 76 mounted on the center portion of the rotation axle 16, a second gear 78 engaging the first gear 76, and a motor 77 rotating the second gear 78. When the rotation axle 16 is rotated by driving the motor 77, the page-width inkjet head unit structure 11 horizontally rotates. It should be noted that the rotation axle 16 may be used as a spindle and the page-width inkjet head unit structure 11 may be configured as a rotating body.

Further, as shown in FIG. 9, an encoder 80 for detecting the amount of rotation of the page-width inkjet head unit structure 11 is mounted on the lower portion of the rotation axle 16. The encoder 80 includes an encoder wheel 81 and an encoder sensor 82 detecting slits in the encoder wheel 81.

Still further, there is a height adjustment mechanism 83 raising and lowering the page-width inkjet head unit structure 11. The height adjustment mechanism 83 includes a third gear (rack) 84 integrally formed on the rotation axle 16 in the direction parallel to the longitudinal direction of the rotation axle 16, a fourth gear 86 engaging the third gear 84, and a motor 85 having a shaft with the fourth gear 86 mounted on the shaft. When the motor 85 is driven, the rotation axle 16 is raised or lowered to adjust (change) the relative height of the page-width inkjet head unit structure 11 while, for example, the maintenance and recovery mechanism section 20 is operated or the page-width inkjet head unit structure 11 is rotated.

Further, to keep the page-width inkjet head unit structure 11 and the conveying belt 12 separated by an appropriate distance, wheels 90 are rotatably mounted on a header part (not shown) and a rotating base part (not shown) of the page-width inkjet head unit structure 11. When the page-width inkjet head unit structure 11 is in the image forming position, the wheels 90 are in contact with the side plate 70 and a side plate 71 included in the belt structure holding the conveying belt 12. As a result, a distance "X" (as shown in FIG. 12) between the page-width inkjet head unit structure 11 and the conveying belt 12 when an image is being formed can be kept constant.

Further, there is a stopper 92 formed on the side plate 71 for restricting the further rotation of the page-width inkjet head unit structure 11. When the page-width inkjet head unit structure 11 is rotated to the image forming position, the page-width inkjet head unit structure 11 is in contact with the stopper 92 and stopped by the stopper 92. As a result, since the rotation of the encoder wheel 81 is also stopped, it is possible to detect that the rotation of the page-width inkjet head unit structure 11 is stopped by monitoring the output of the encoder 80. On the other hand, there is another stopper 93 on the maintenance and recovery mechanism section 20 to restrict the rotation of the page-width inkjet head unit structure 11.

When the page-width inkjet head unit structure 11 rotates to the evacuating position, the page-width inkjet head unit structure 11 is in contact with the stopper 93 and stopped by the stopper 93. As a result, since the rotation of the encoder wheel 81 is also stopped, it is possible to detect that the rotation of the page-width inkjet head unit structure 11 is stopped by monitoring the output of the encoder 80. When the stopping of the page-width inkjet head unit structure 11 is detected by monitoring the output of the encoder 80, the driving rotation of the motor 77 for driving the rotation axle 16 is stopped. In this manner, the page-width inkjet head unit structure 11 can be rotated to the image forming position for printing and the evacuating position for waiting or maintenance and recovery operations. By physically restricting the positions of the page-width inkjet head unit structure 11 as described above, it is possible to accurately determine the position of the page-width inkjet head unit structure 11 at the image forming position, thereby improving the quality of an image. Similarly, it is possible to accurately determine the position of the page-width inkjet head unit structure 11 at the evacuating position, thereby ensuring the capping by a cap member 28.

Further, there are sensors 95 and 96 as shown in FIG. 10. The sensor 95 detects that the page-width inkjet head unit structure 11 is at the image forming position (printing position). The sensor 96 detects the page-width inkjet head unit structure 11 is at the evacuating position for waiting or maintenance and recovery operations. A signal for driving the motor 77 is controlled based on the detected signals from those sensors 95 and 96.

The conveying belt 12 is an endless belt rotatably stretched around a driving roller 17 and an idler roller 18 and is rotated in accordance with the rotation of the driving roller 17 driven by a motor (not shown). Further, there are detecting sensors 98 and 99 on upstream and downstream sides, respectively, of the conveying belt 12 for detecting a medium to be recorded on (recording paper "P"). A paper jam is detected by monitoring the output signals from the detecting sensors 98 and 99.

Further, as shown in FIG. 9, the maintenance and recovery mechanism section 20 includes a wiper 27 and caps 28. The wiper 27 wipes and cleans the surfaces of the nozzle plates 34*a* and 34*b* of the head section 31 (hereinafter simply referred to as "nozzle surface") so as to form a nozzle meniscus surface. The caps 28 seal the nozzle surface for maintaining the humidity of the nozzle surface. The wiper 27 is raised when the wiping operation is performed and wipes the nozzle surface when the nozzle surface is moved relative to the wiper 27 by rotating the page-width inkjet head unit structure 11. The caps 28 are raised for maintaining the humidity of the nozzle surface by capping the nozzle surface so as not to dry the nozzle surface during waiting.

Figure 13:
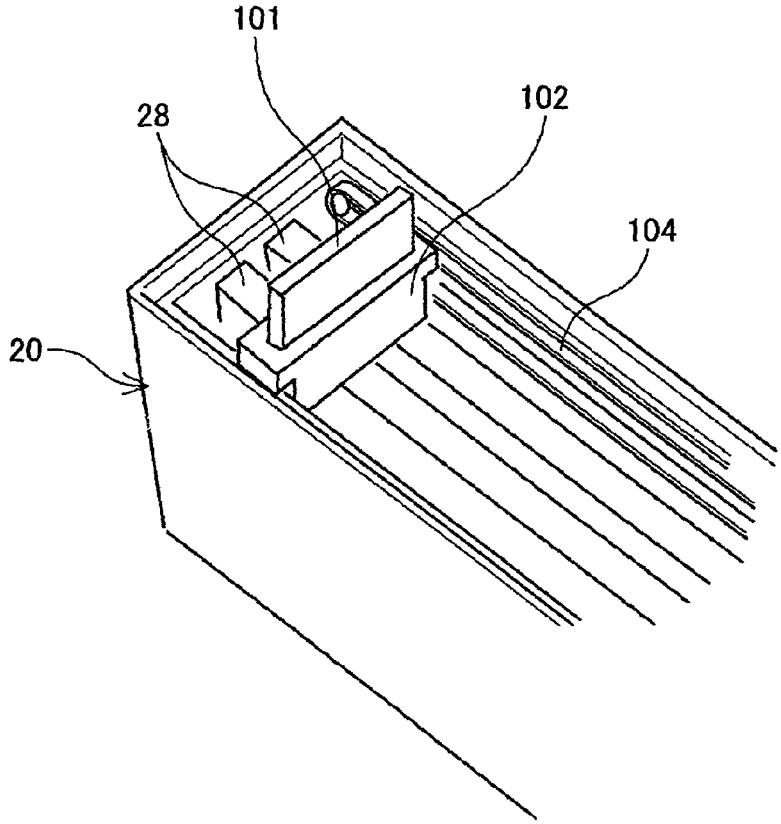
FIG. 13 is a perspective view of another example of the maintenance and recovery mechanism section of the apparatus according to the first embodiment of the present invention.

Next, another example of the maintenance and recovery mechanism section 20 is described with reference to FIG. 13. The maintenance and recovery mechanism section 20 includes a holder 102, a wiper 101 mounted on the holder 102, and a belt 104. The wiper 101 is moved and scanned in the longitudinal direction of the maintenance and recovery mechanism section 20 by the belt 104 so as to wipe the nozzle surface of the head section 31.

Next, the operations of an image forming apparatus having the configuration as described above are described with reference to FIG. 14, a flowchart, and FIGS. 15A and 15B, top views of the apparatus.

Figure 14:
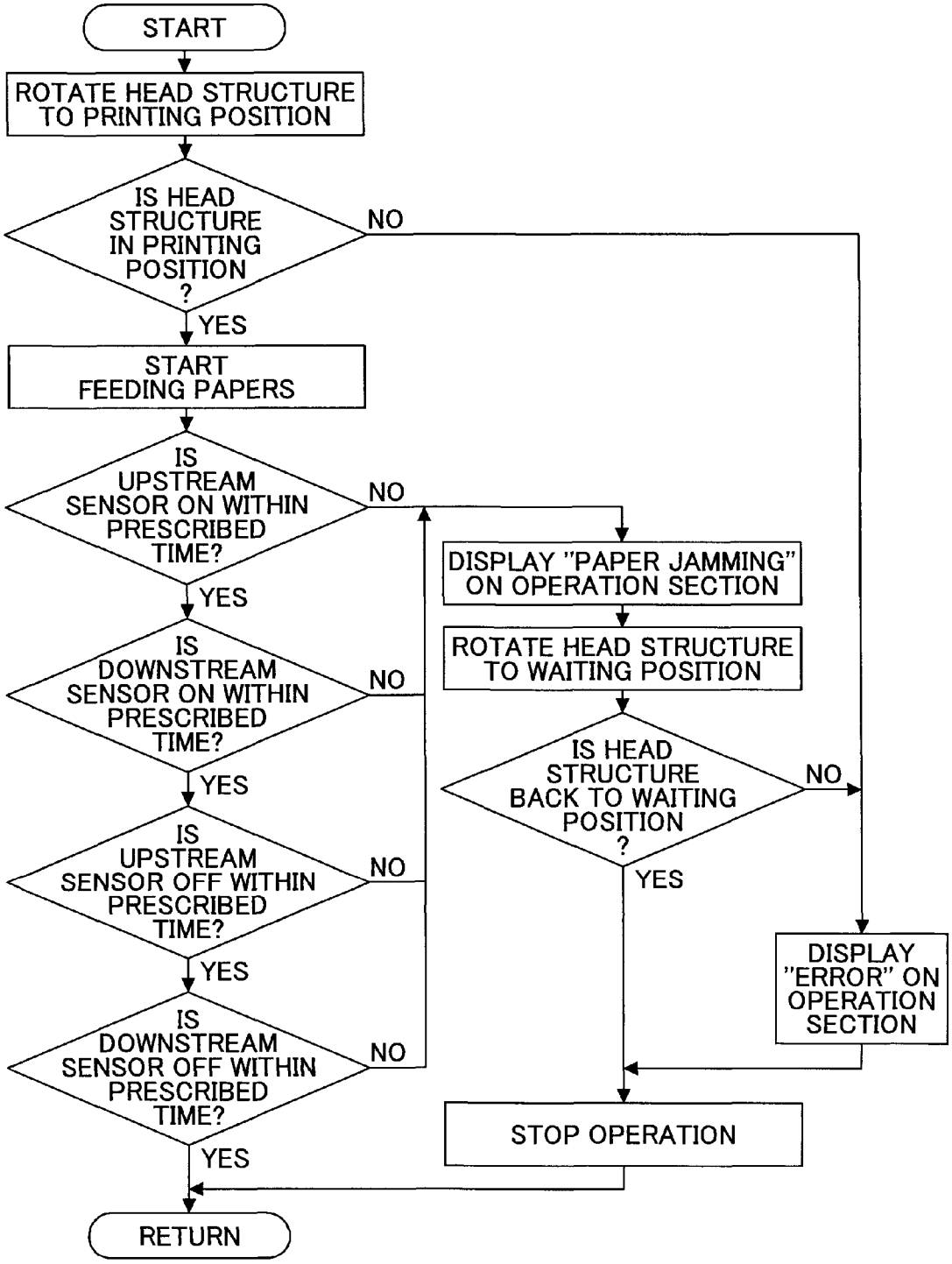
FIG. 14 is a flowchart showing a process of the rotation driving control of the page-width inkjet head unit structure of the apparatus according to the first embodiment of the present invention.
Figure 15A:
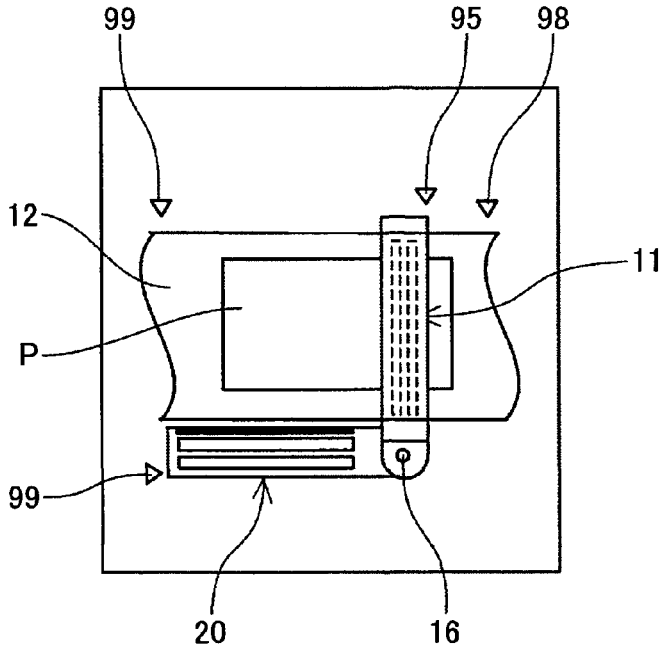
FIGS. 15A and 15B are top views showing different positions of the page-width inkjet head unit structure.
Figure 15B:
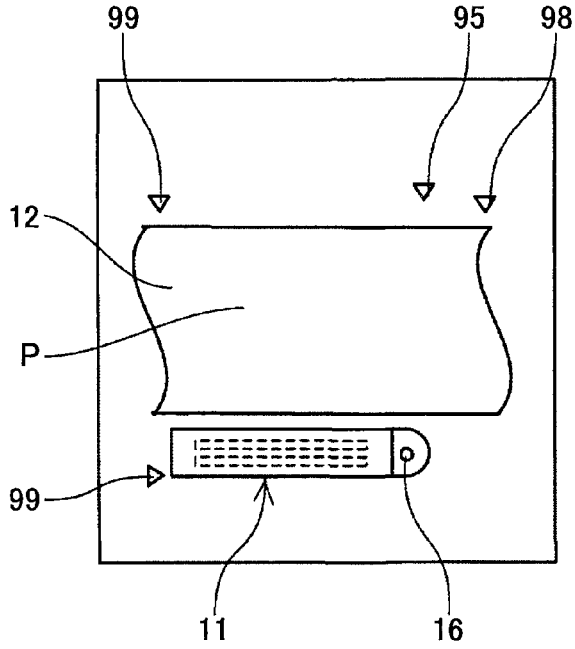

First, referring to FIG. 14, when a print instruction is transmitted to the apparatus, the motor 77 of the head rotation driving mechanism 75 is driven to rotate the page-width inkjet head unit structure 11 from the evacuating position (waiting position) to the image forming position (printing position). Then, it is determined whether the page-width inkjet head unit structure 11 is rotated to the printing position by checking whether the sensor 95 detects the page-width inkjet head unit structure 11 within a prescribed time.

When it is determined that the page-width inkjet head unit structure 11 is rotated to the printing position within the prescribed time (status in FIG. 15A), a feeding operation is started to feed the recording paper "P" from the recording paper cassette 4. Then, when, for example, the detecting sensor 98 located on the upstream side of the conveying belt 12 is turned ON within a prescribed time after the feeding operation is started, the detecting sensor 99 located on the downstream side of the conveying belt 12 is turned ON within a prescribed time after the sensing sensor 98 is turned ON, the detecting sensor 98 is turned OFF within a prescribed time after the detecting sensor 99 is turned ON, and the detecting sensor 99 is turned OFF within a prescribed time after the detecting sensor 98 is turned OFF, so that it is determined that the printing operation is successfully performed. Therefore, the process is ended.

On the other hand, when it is detected that the page-width inkjet head unit structure 11 is not rotated to the printing position within the prescribed time, it is determined that some trouble has occurred. For example, foreign matter such as a jammed paper prevents the page-width inkjet head unit structure 11 from rotating, or the driving motor 77 of the head rotation driving mechanism 75 does not work. In this case, an "ERROR" message is displayed on the operations section 24 and the operation is stopped.

Further, after the feeding operation is started, when timeout is detected in any of the sequential steps of turning ON the sensor 98, turning ON the sensor 99, turning OFF the sensor 98, and turning OFF the sensor 99 within the prescribed time period (namely, any of the steps is not performed within the prescribed time period), it is determined that the some trouble has occurred. Then "Paper Jamming" is displayed on the operations section 24 and the motor 77 of the head rotation driving mechanism 75 is rotated in the reverse direction so that the page-width inkjet head unit structure 11 is rotated in the direction away from the printing position to the waiting position. Then, it is determined whether the sensor detecting that the page-width inkjet head unit structure 11 is at the waiting position (status shown in FIG. 15B) is turned ON within a prescribed time. When it is determined that the page-width inkjet head unit structure 11 is normally rotated to the waiting position, the operation is stopped. When it is determined that the page-width inkjet head unit structure 11 is not normally rotated to the waiting position, an "ERROR" message is displayed and the operation is stopped.

Figure 16:
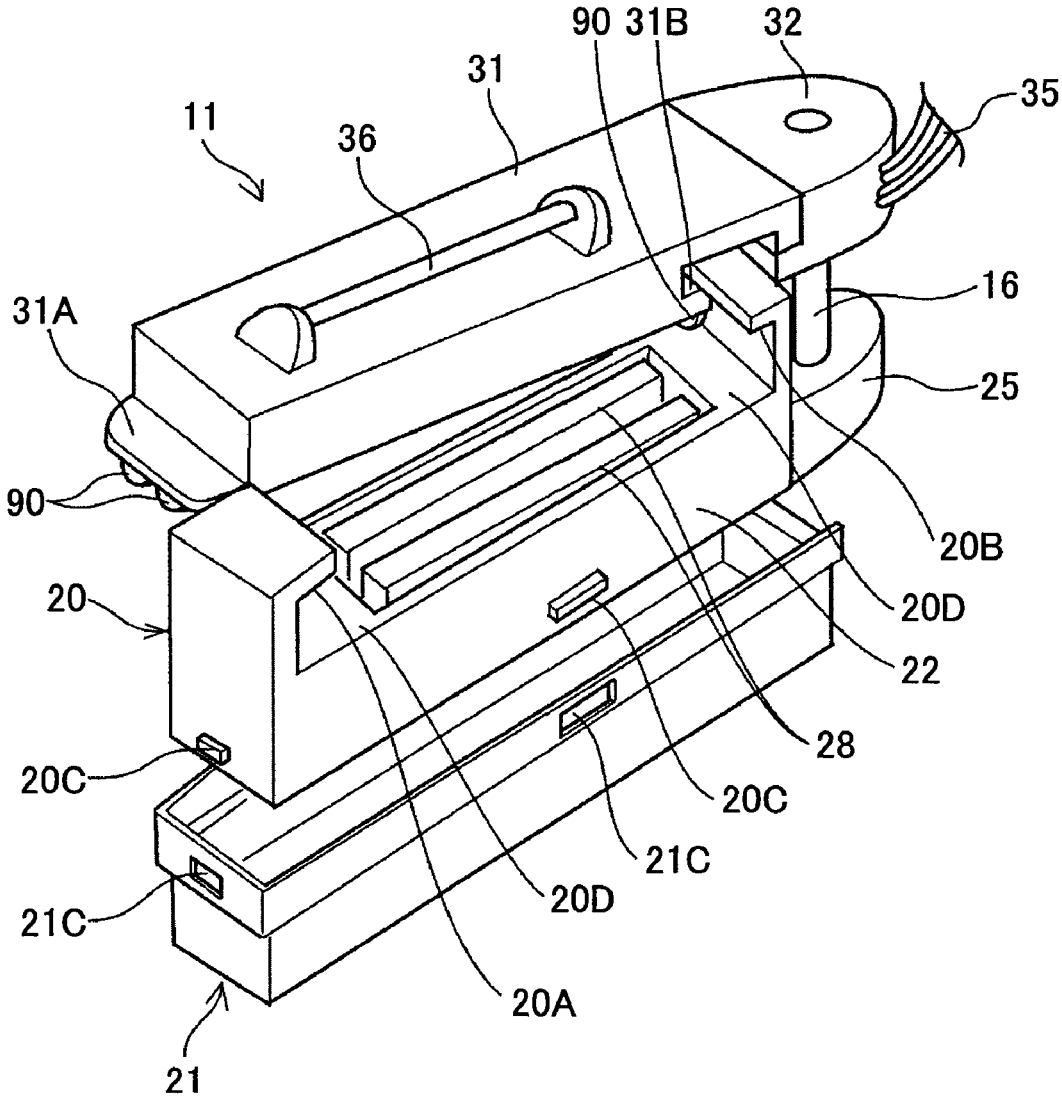
FIG. 16 is a perspective view showing a connection structure between the page-width inkjet head unit structure and the maintenance and recovery mechanism section.
Figure 17:
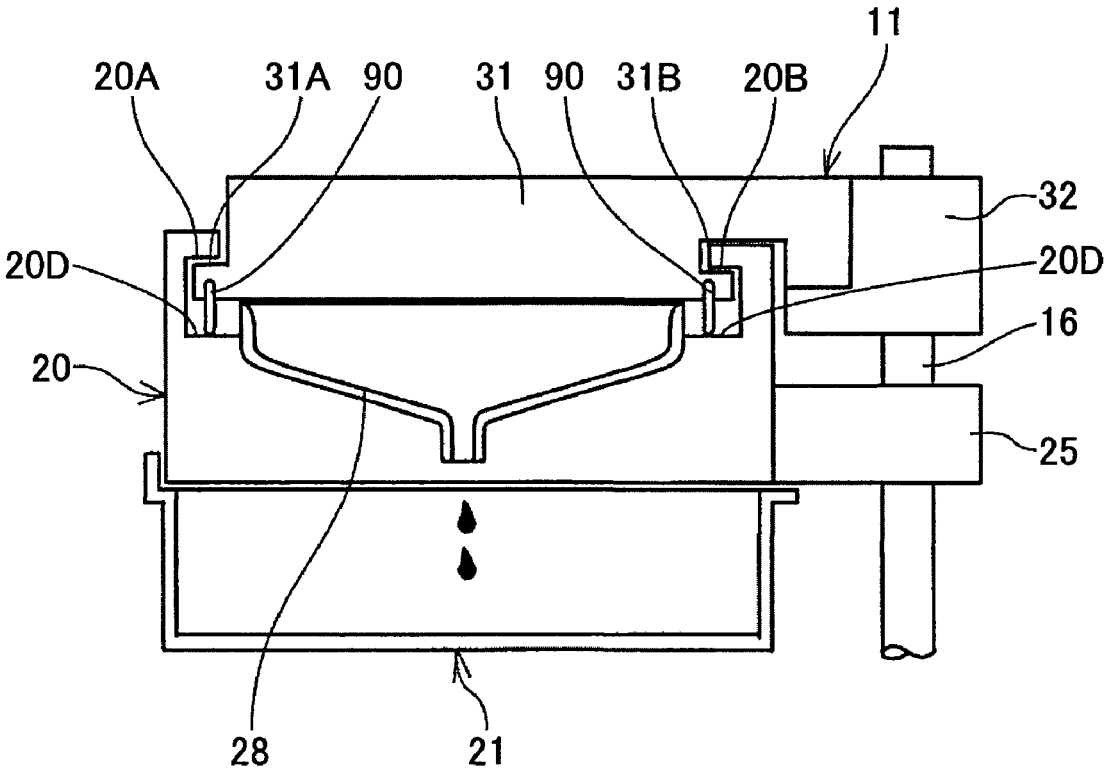
FIG. 17 is a cut-open view of the connection structure in FIG. 16.

Next, the head section 31, the maintenance and recovery mechanism section 20, and the waste tank 21 that are structured as a single unit removably mounted on the recording section 3 of the apparatus main body 1 are described with reference to the FIGS. 16 and 17. FIG. 16 is a perspective view and FIG. 17 is a cut-open view of the integrated body.

The maintenance and recovery mechanism section 20 includes fitting sections 20A and 20B provided one on each side in the longitudinal direction. Similarly, the page-width inkjet head unit structure 11 includes fitting sections 31A and 31B provided one on each side in the longitudinal direction so as to fit the fitting sections 20A and 20B, respectively, of the maintenance and recovery mechanism section 20. By using the fitting sections 20A, 20B, 31A, and 31B, the head section 31 can be fit with the maintenance and recovery mechanism section 20.

Because of this structure, when the page-width inkjet head unit structure 11 is rotated to above the maintenance and recovery mechanism section 20, the fitting sections 31A and 31B of the head section 31 are fit (engaged) with the fitting sections 20A and 20B, respectively, of the maintenance and recovery mechanism section 20. Further, the maintenance and recovery mechanism section 20 includes contacting surfaces 20D in contact with the wheels 90 of the page-width inkjet head unit structure 11 so that the height of the head section 31 is determined by the wheels 90 of the head section 31 contacting the contacting surfaces 20D of the maintenance and recovery mechanism section 20.

Further, a frame 22 of the maintenance and recovery mechanism section 20 is removably mounted on a supporting section 25. The supporting section 25 is positioned relative to and supported by the rotation axle 16. By this structure, the positional relationship between the head section 31 and the maintenance and recovery mechanism section 20 is determined. Further, ink ejected during, for example, the wiping operation or idle ejecting operation is arranged to be stored in the waste tank 21 under the maintenance and recovery mechanism section 20. This waste tank 21 includes engagement holes 21C and, on the other hand, the frame 22 of the maintenance and recovery mechanism section 20 includes the corresponding convex portions (protrusions) 20C. By engaging each convex portion 20C in the corresponding engagement hole 21C, the waste tank 21 is fixed to and connected to the frame 22 of the maintenance and recovery mechanism section 20.

Because of this structure, when the page-width inkjet head unit structure 11 is in the waiting position, the head section 31, the maintenance and recovery mechanism section 20, and the waste tank 21 are integrally mounted on each other (as a single body). Therefore, by raising the handle 36 mounted on the head section 31, the head section 31 is removed from the head supporting section 32 and, at the same time, the maintenance and recovery mechanism section 20 is removed from the supporting section 25. As a result, advantageously, it is possible to remove the head section 31, the maintenance and recovery mechanism section 20, and the waste tank 21 together in a single operation from the apparatus main body 1.

In addition, in this single operation, the head section 31 is removed while the nozzle surface of the head section 31 is sealed by the cap 28 of the maintenance and recovery mechanism section 20. Therefore, it is possible to prevent ink remaining in the nozzles or inside of the head section 31, the maintenance and recovery mechanism section 20, and the waste tank 21 from leaking to the outside. On the contrary, when it is necessary to attach the head section 31 in the apparatus main body 1, the same procedure in the reverse order is performed.

Further, since the maintenance and recovery mechanism section 20 and the waste tank 21 together can be mounted on and detached from the apparatus main body 1 in a single operation, it is possible to replace the waste tank 21 as well when the head section 31 is replaced. In addition, since the maintenance and recovery mechanism section 20 and the waste tank 21 are not separated from each other when mounted on and detached from the apparatus main body 1, it is possible to prevent the waste fluid in the maintenance and recovery mechanism section 20 and the waste tank 21 from leaking to the outside.

It should be noted that in a case where the waste tank 21 is not mounted on and connected to the maintenance and recovery mechanism section 20, only the head section 31 and the maintenance and recovery mechanism section 20 can be mounted on and detached from the apparatus main body 1 in a single operation.

Next, additional examples of the positioning mechanism for positioning the page-width inkjet head unit structure 11 are described with reference to schematic drawings of FIGS. 18A, 18B, 19A and 19B.

Figure 18A:
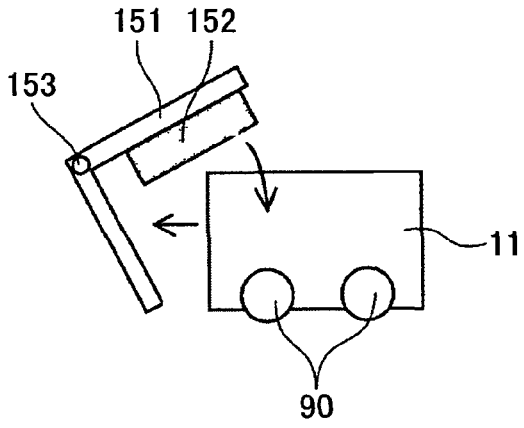
FIGS. 18A and 18B are schematic views illustrating one example of the positioning mechanism of the page-width inkjet head unit structure.
Figure 18B:
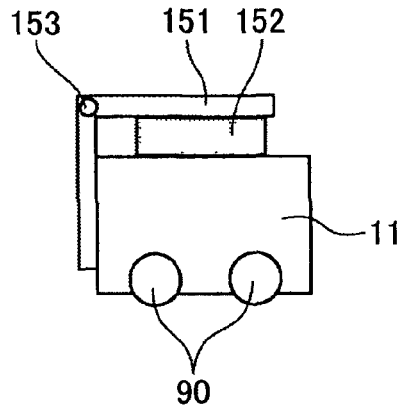

FIGS. 18A and 18B show an example where the positioning mechanism includes a substantially L-shaped swing arm 151 with a pressing member 152 thereon and an axle 153, wherein the swing arm 151 is swingably mounted on the axle 153. When the page-width inkjet head unit structure 11 is moved in the arrow direction to the image forming position as shown in FIG. 18A, the swing arm 151 is pressed by the page-width inkjet head unit structure 11 and is swung clockwise so that the pressing member 152 presses downward on the top of the page-width inkjet head unit structure 11, thereby positioning and holding the page-width inkjet head unit structure 11 in the image forming position as shown in FIG. 18B.

Figure 19A:
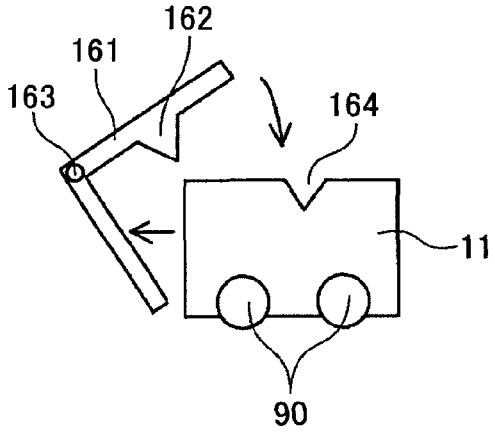
FIGS. 19A and 19B are schematic views illustrating another example of the positioning mechanism of the page-width inkjet head unit structure.
Figure 19B:
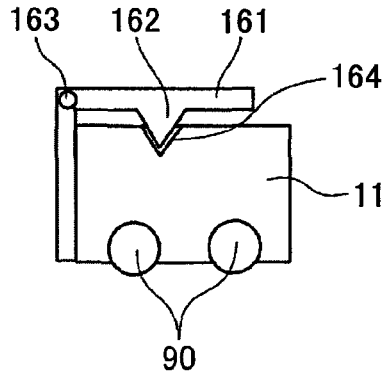

FIG. 19 shows another example of the positioning mechanism including a substantially L-shaped swing arm 161 with an engaging section 162 formed thereon and an axle 163. The swing arm 161 is swingably mounted on the axle 163. When the page-width inkjet head unit structure 11 is moved in the arrow direction to the image forming position as shown in FIG. 19A, the swing arm 161 is pressed by the page-width inkjet head unit structure 11 and is swung clockwise so that the engaging section 162 is engaged with an engaging concave section 164 formed on the top surface of the page-width inkjet head unit structure 11 to press downward on the page-width inkjet head unit structure 11, thereby positioning and holding the page-width inkjet head unit structure 11 in the image forming position as shown in FIG. 19B.

Figure 20A:
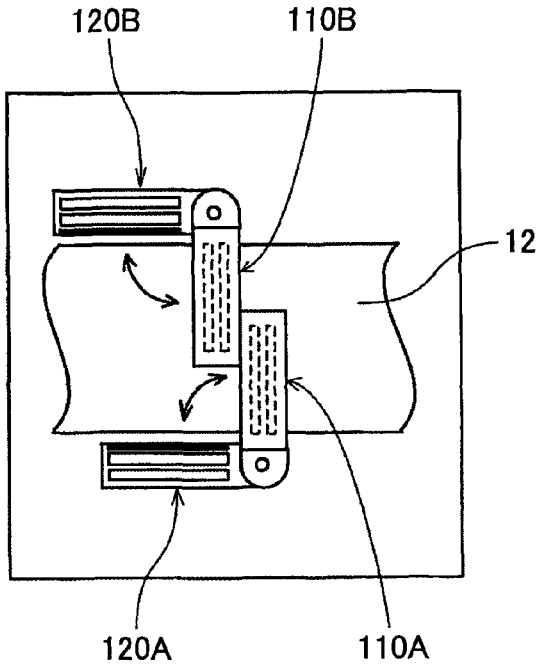
FIGS. 20A and 20B are schematic views illustrating a second embodiment of the present invention.
Figure 20B:
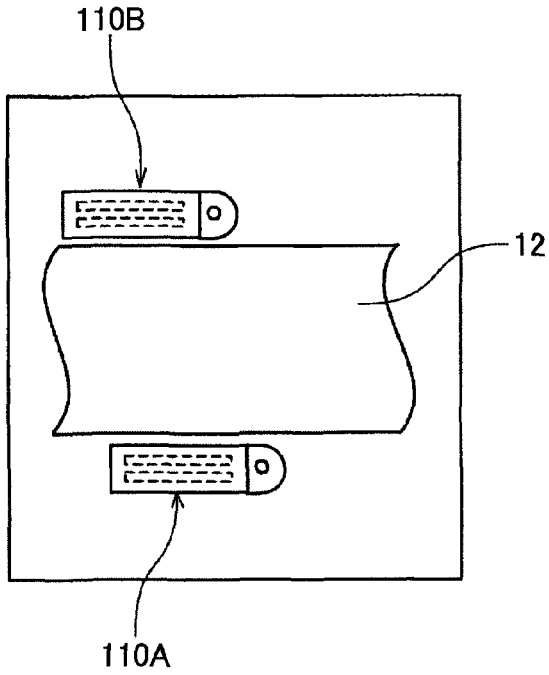

Next, a second embodiment of the present invention is described with reference to schematic top views FIGS. 20A and 20B. In this embodiment, two separate page-width inkjet head unit structures 110A and 110B are horizontally rotatably disposed over the conveying belt 12. In addition, when the page-width inkjet head unit structures 110A and 110B are in the corresponding printing positions, the page-width inkjet head unit structures 110A and 110B are arranged to be disposed in different positions in the direction substantially parallel to the medium to be recorded conveying direction (horizontal direction in FIGS. 20A and 20B), and the longitudinal directions of the page-width inkjet head unit structures 110A and 110B are substantially orthogonal to the medium to be recorded on conveying direction (vertical direction in FIGS. 20A and 20B) as shown in FIG. 20A. By using those page-width inkjet head unit structures 110A and 110B together, the same effect as obtained with a single page-width inkjet head unit is obtained for forming an image onto a medium to be recorded on. Further, there are two separate maintenance and recovery mechanism sections 120A and 120B disposed in the areas other than the area of the conveying belt 12 in response to the corresponding page-width inkjet head unit structures 110A and 110B. When in waiting or maintenance and recovery operations, the two page-width inkjet head unit structures 110A and 110B are rotated to the position (evacuating position) facing the maintenance and recovery mechanism sections 120A and 120B, respectively, as shown in FIG. 20B.

In this embodiment, the page-width inkjet head unit structure 110A together with the maintenance and recovery mechanism section 120A, and the page-width inkjet head unit structure 110B together with the maintenance and recovery mechanism section 120B can also be mounted on and detached from the apparatus main body 1 when the same structure as that in the first embodiment of the present invention is employed in the elements of the second embodiment.

Next, a third embodiment of the present invention is described with reference to schematic drawings of FIGS. 21A, 21B, 21C, 22, 23, and 24. In this embodiment, a page-width inkjet head unit 200 (200*y*, 200*m*, 200*c*, and 200*k*) includes a head part and a fluid tank supplying fluid to the head part, wherein the head part and the fluid tank are integrally formed. The page-width inkjet head unit 200 is movably disposed in the upward/downward directions. On the other hand, the maintenance and recovery mechanism section 201 (201*y*, 201*m*, 201*c*, and 201*k*) is movably disposed in the horizontal directions. Further, a cap member 202 for capping (sealing) the nozzle surface of the page-width inkjet head unit 200 is movably disposed in the upward/downward directions inside the maintenance and recovery mechanism section 201 and is biased to an upward position (but the upper-most elevated position is restricted to the position shown in FIG. 21A).

Figure 23:
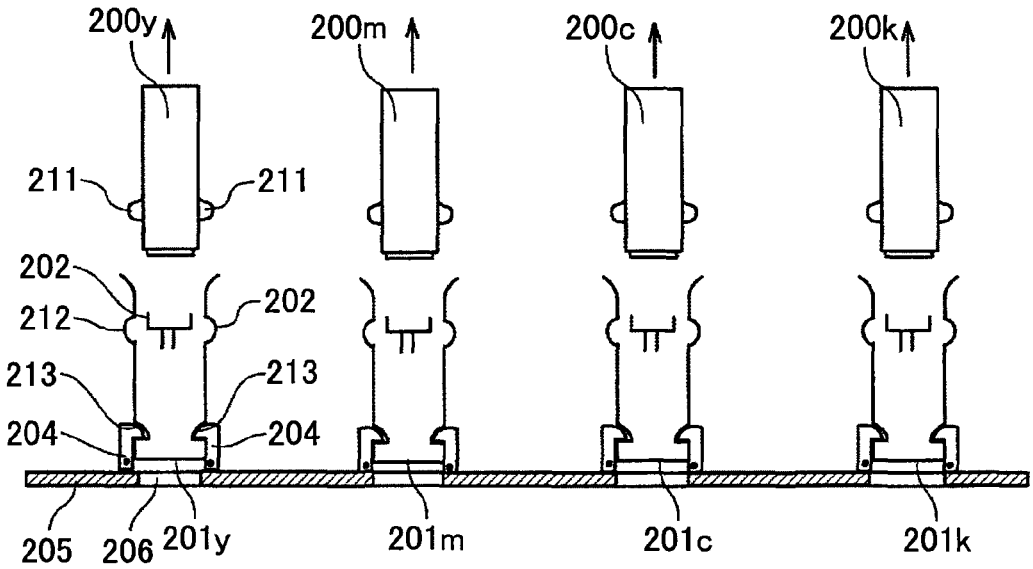
FIG. 23 is a schematic view illustrating a print preparation status according to the third embodiment of the present invention.
Figure 24:
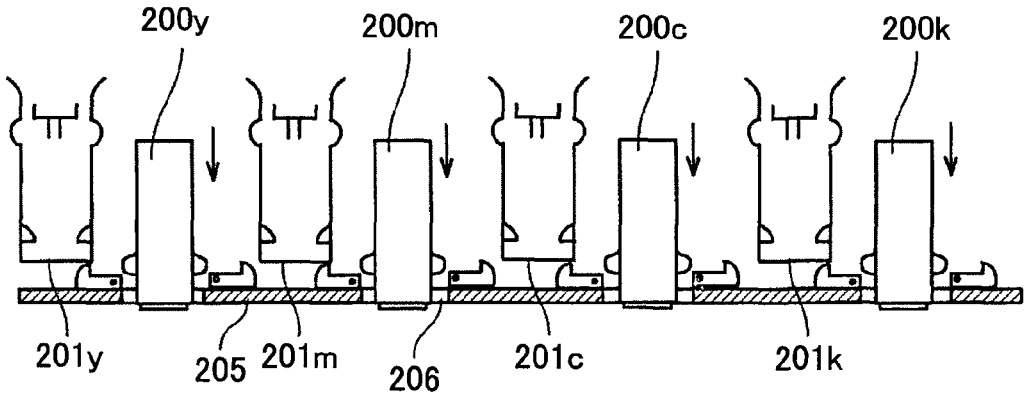
FIG. 24 is a schematic view illustration a printing status according to the third embodiment of the present invention.

Further, there are engaging convex sections 211 provided one on each side of the surface of the page-width inkjet head unit 200. On the other hand, there are engaging concave sections 212 provided one on each upper side of the inner surface of the maintenance and recovery mechanism section 201 so that the engaging convex sections 211 can engage the corresponding engaging concave sections 212. By engaging the engaging convex sections 211 with the corresponding engaging concave sections 212, the page-width inkjet head unit 200 can be integrally mounted on the maintenance and recovery mechanism section 201. Further, as shown in FIG. 23, there are engaging concave sections 213 provided one on each lower side of the outer surface of the maintenance and recovery mechanism section 201. On the other hand, there are locking members 204 rotatably provided on a supporting member 205 in the apparatus main body 1.

Figure 21A:
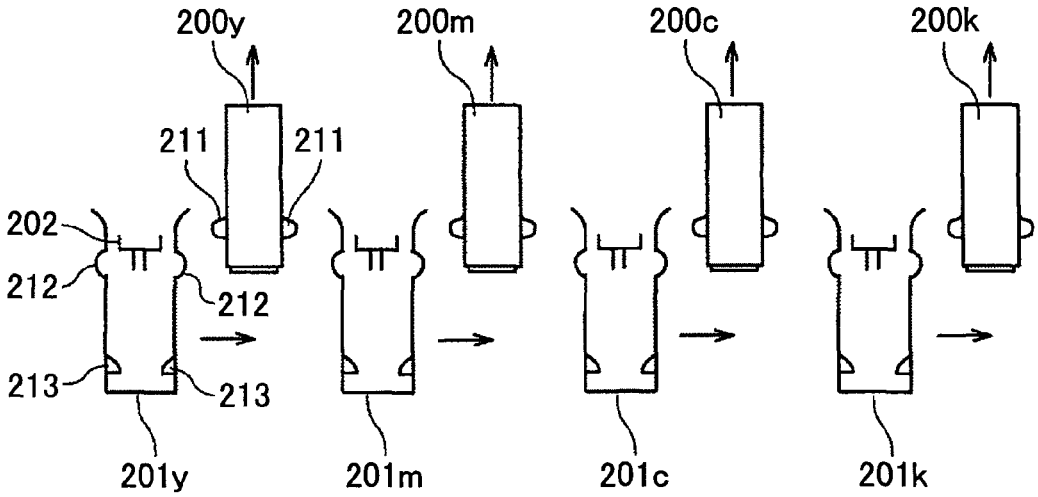
FIGS. 21A through 21C are schematic views illustrating a third embodiment of the present invention.

In this structure, to attach the page-width inkjet head unit 200 to the maintenance and recovery mechanism section 201, first, the page-width inkjet head unit 200 is raised in the arrow direction shown in FIG. 21A. Then, the maintenance and recovery mechanism section 201 is horizontally shifted in the arrow direction under the page-width inkjet head unit 200. Next, the page-width inkjet head unit 200 is lowered in the arrow direction shown in FIG. 21B so that the cap member 202 caps (seals) the nozzle surface of the page-width inkjet head unit 200.

Figure 21B:
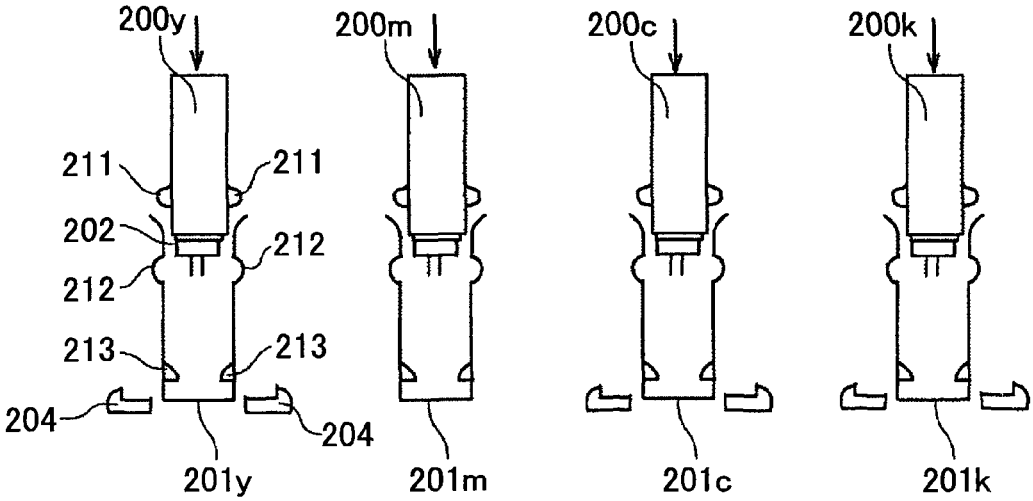
Figure 21C:
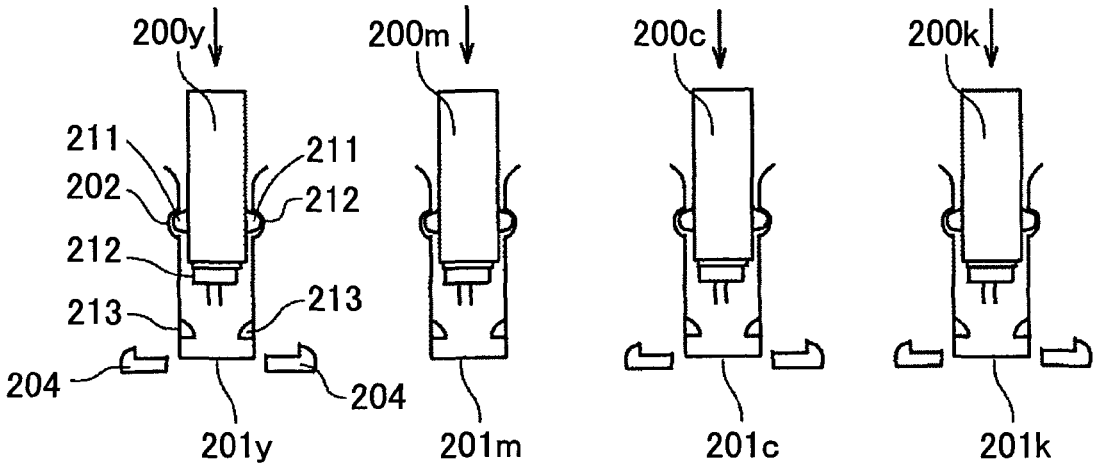

Further, to integrally remove the page-width inkjet head unit 200 together with the maintenance and recovery mechanism section 201, the page-width inkjet head unit 200 is further lowered from the position shown in FIG. 21B until the engaging convex sections 211 of the page-width inkjet head unit 200 engage the corresponding engaging concave sections 212 of the maintenance and recovery mechanism section 201. As a result, the page-width inkjet head unit 200 is mounted on the maintenance and recovery mechanism section 201.

Figure 22:
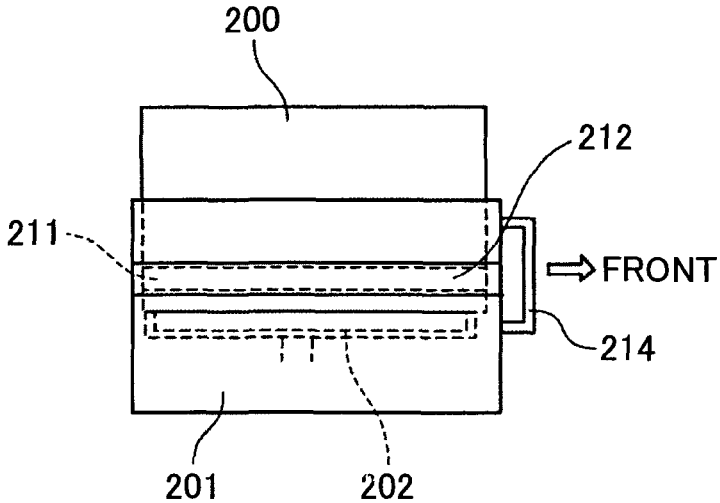
FIG. 22 is a schematic view illustrating a status where the head section is mounted on the maintenance and recovery mechanism section according to the third embodiment of the present invention.

In this status, when, for example, the handle 214 mounted on the maintenance and recovery mechanism section 201 is extracted in the arrow direction shown in FIG. 22, the page-width inkjet head unit 200 together with the maintenance and recovery mechanism section 201 are integrally removed from the apparatus main body 1 while the cap member 202 caps the nozzle surface of the page-width inkjet head unit 200.

On the contrary, to integrally attach the page-width inkjet head unit 200 together with the maintenance and recovery mechanism section 201 to the apparatus main body 1 to start printing, first, the page-width inkjet head unit and the maintenance and recovery mechanism section 201 are inserted in the direction opposite to the arrow direction shown in FIG. 22 into the apparatus main body 1. Then, the locking members 204 are rotated so as to engage the corresponding engaging concave sections 201 as shown in FIG. 23. Next, the page-width inkjet head unit 200 is raised in the arrow direction to release the engagement between the engaging concave sections 212 of the maintenance and recovery mechanism section 201 and the corresponding engaging convex sections 211 of the page-width inkjet head unit 200. As a result, the page-width inkjet head unit 200 is extracted from the maintenance and recovery mechanism section 201. Further, to set the page-width inkjet head unit 200 for printing, first, the maintenance and recovery mechanism section 201 is moved from under the page-width inkjet head unit 200. Next, the page-width inkjet head unit 200 is lowered in the arrow direction shown in FIG. 24 so that the lower end of the page-width inkjet head unit 200 is extended through an opening 206 of the supporting member 205.

As described above, when page-width inkjet head unit 200 is movably arranged in the upward/downward directions, and either the page-width inkjet head unit 200 or the maintenance and recovery mechanism section 201 has an engaging section so that the page-width inkjet head unit 200 is engaged with the maintenance and recovery mechanism section 201 when the page-width inkjet head unit is lowered to the maintenance and recovery mechanism section 201, it is possible to extract the page-width inkjet head unit 200 together with the maintenance and recovery mechanism section 201 from the apparatus main body 1 and to contain the ink leaked from the nozzle of the page-width inkjet head unit in use in the maintenance and recovery mechanism section 201, thereby facilitating the replacement operation.

In this structure, the page-width inkjet head unit 200 is movably disposed in upward/downward directions. The maintenance and recovery mechanism section 201 includes caps to seal the page-width inkjet head unit 200 and fitting sections so that the page-width inkjet head unit 200 can integrally attach to the maintenance and recovery mechanism section 201. The fitting sections are disposed below a first position where the page-width inkjet head unit 200 is first in contact with the caps when the page-width inkjet head unit 200 is lowered. Because of this structure, it is possible to switch between capping and the (integrally) connecting simply by raising and lowering the page-width inkjet head unit 200.

Next, a fourth embodiment of the present invention is described with reference to the schematic drawings of FIGS. 25A through 25D, 26, 27, and 28.

In this embodiment, page-width inkjet head unit 300 (300*y*, 300*m*, 300*c*, and 300*k*) is integrally mounted on a head holder 400 and is horizontally movably disposed in the medium to be recorded conveying direction. Further, a maintenance and recovery mechanism section 301 is disposed on the downstream side of the conveying belt 12. In the maintenance and recovery mechanism section 301, there is a cap member 302 for capping (sealing) the nozzle surface of the page-width inkjet head unit 300, and the cap member is biased upward.

Further, there are engaging convex sections 311 elongated one on each side surface of the head holder 400 (both ends of the head holder 400 in the direction vertical to the medium to be recorded conveying direction). On the other hand, there are engaging concave sections 312 elongated one on each side surface of the maintenance and recovery mechanism section 301 such that the engaging concave sections 312 engage the engaging convex sections 311. By engaging the engaging convex sections 311 with the engaging concave section 312, the page-width inkjet head unit 300 can be integrally mounted on the maintenance and recovery mechanism section 301.

Figure 25A:
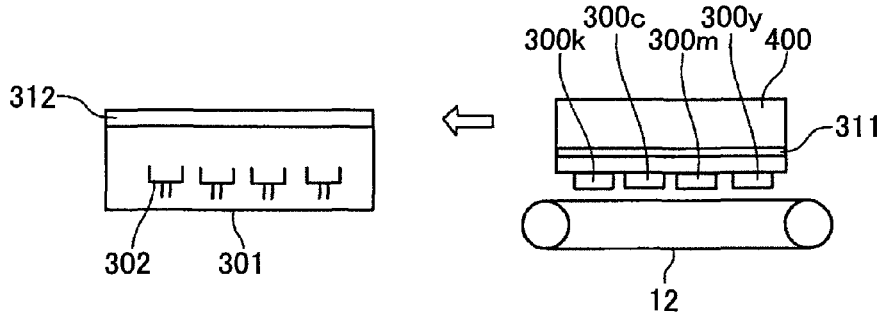
FIGS. 25A through 25D are views illustrating a fourth embodiment of the present invention.
Figure 25B:
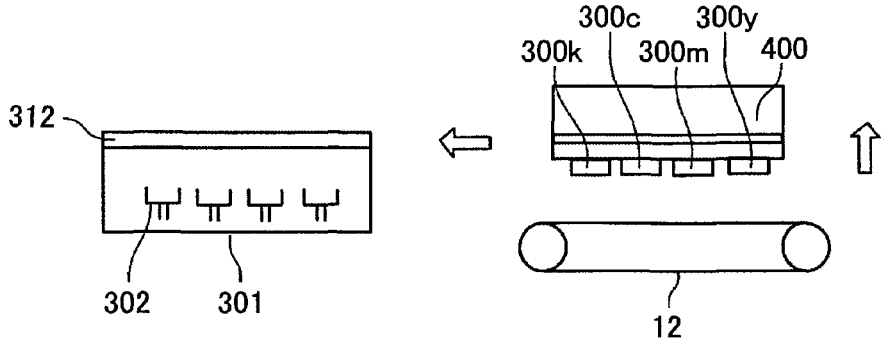
Figure 25C:
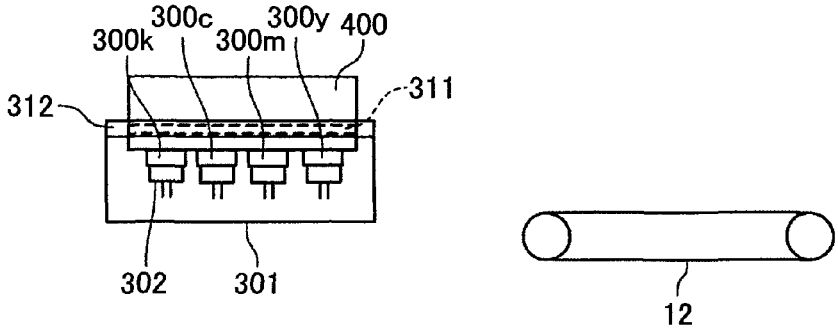

Because of this structure, to attach the page-width inkjet head unit 300 to the maintenance and recovery mechanism section 301, first, the page-width inkjet head unit 300 in the printing position shown in FIG. 25A is moved to the downstream side in the medium to be recorded conveying direction (arrow direction) shown in FIG. 25B so that the engaging convex sections 311 of the page-width inkjet head unit 300 are engaged with the corresponding engaging concave sections 312 of the maintenance and recovery mechanism section 301. AS a result, the page-width inkjet head unit 300 is mounted on the maintenance and recovery mechanism section 301. Then the cap member 302 is raised to cap (seal) the nozzle surface of the page-width inkjet head unit 300.

Figure 25D:
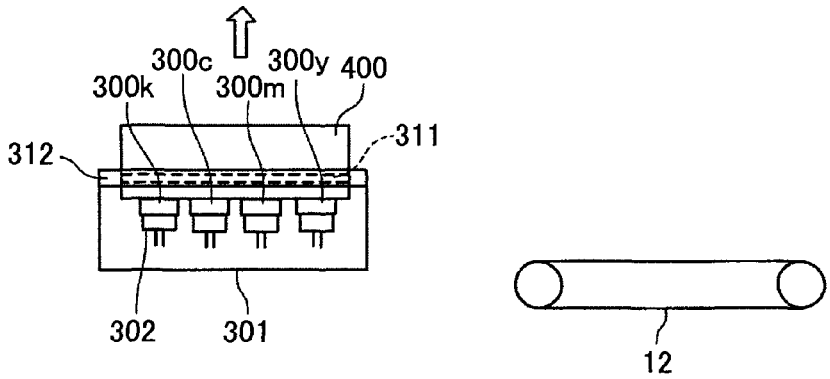
Figure 26:
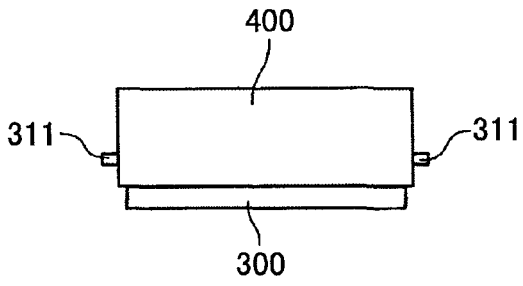
FIG. 26 is a side view of the head section according to the fourth embodiment of the present invention.
Figure 27:
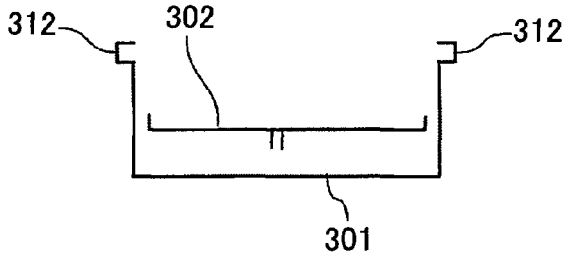
FIG. 27 is a side view of the maintenance and recovery mechanism section according to the fourth embodiment of the present invention.
Figure 28:
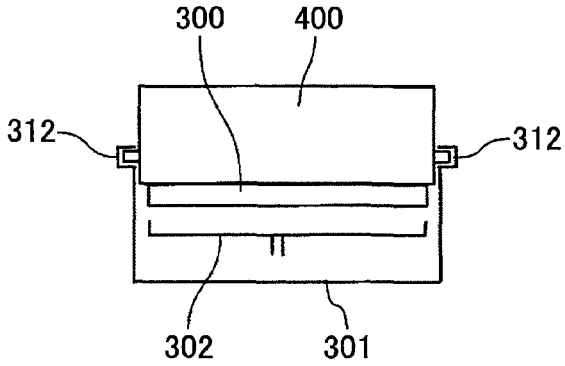
FIG. 28 is a schematic view illustrating a status where the head section is mounted on the maintenance and recovery mechanism section according to the fourth embodiment of the present invention.

From this status, the page-width inkjet head unit 300 and the maintenance and recovery mechanism section 301 are integrally extracted upward in the arrow direction shown in FIG. 25D (or pulled in proximal direction) to remove the page-width inkjet head unit 300 and the maintenance and recovery mechanism section 301 from the apparatus main body while the cap member 302 caps the nozzle surface of the page-width inkjet head unit 300. It should be noted that, when it is necessary to integrally attach the page-width inkjet head unit 300 together with the maintenance and recovery mechanism section 301 to the apparatus main body 1, the same procedure in the reverse order is performed.

In this fourth embodiment, as described above, the page-width inkjet head unit is horizontally movably disposed so that the page-width inkjet head unit is moved between the image forming position for forming an image and the evacuating position separated from the image forming position, and the maintenance and recovery mechanism section has an engagement section so that the page-width inkjet head unit engages the maintenance and recovery mechanism section when the page-width inkjet head unit is in the evacuating position. With this configuration, it is also possible to extract the page-width inkjet head unit in use together with the maintenance and recovery mechanism section from the apparatus main body while the page-width inkjet head unit is mounted on the maintenance and recovery mechanism section and to contain the ink leaked from the nozzle of the page-width inkjet head unit in use into the maintenance and recovery mechanism section, thereby facilitating the replacement operation.

In the above embodiments, the conveying belt is used as a conveying unit for conveying a medium to be recorded. However, any rotating body such as a roller may also be used.

The present invention is not limited to the above-mentioned embodiments, and variations and modifications may be made without departing from the scope of the present invention.

The present application is based on and claims the benefit of priority of Japanese Patent Application No. 2007-071118, filed on Mar. 19, 2007, the entire contents of which are hereby incorporated by reference.

What is claimed is:

1. An image forming apparatus comprising:

an apparatus main body;

a page-width inkjet head unit capable of ejecting fluid droplets without substantially moving the page-width inkjet head unit while forming an image on a recording medium; and a maintaining and recovering unit maintaining and recovering a function of a nozzle of the page-width inkjet head unit, the maintaining and recovering unit including a waste tank configured to store waste fluid that was ejected by the page-width inkjet head unit, was not used for image formation and was recovered by the maintaining and recovering unit; and an engaging unit that engages the page-width inkjet head unit and the maintaining and recovering unit, including the waste tank, together as a single unit and maintains the positional relationship between the page-width inkjet head unit and the maintaining and recovering unit, including the waste tank, within the single unit, when the page-width inkjet head unit and the maintaining and recovering unit, including the waste tank, are removed from the apparatus main body as a single unit along with the engaging unit.

2. The image forming apparatus according to claim 1, further comprising:

a fluid tank mounted on the page-width inkjet head unit, wherein the page-width inkjet head unit and the fluid tank are removably mounted on the apparatus main body as a single unit.

3. The image forming apparatus according to claim 1, wherein the waste tank is mounted on the maintaining and recovering unit.

4. The image forming apparatus according to claim 1, wherein the page-width inkjet head unit is movably disposed in upward/downward directions; and either the page-width inkjet head unit or the maintaining and recovering unit includes an engaging unit for engaging the page-width inkjet head unit and the maintaining and recovering unit together as a single unit when the page-width inkjet head unit is lowered.

5. The image forming apparatus according to claim 1, wherein the page-width inkjet head unit is movably disposed in upward/downward directions; and the maintaining and recovering unit includes a cap unit for sealing the page-width inkjet head unit, and an engaging unit for engaging the page-width inkjet head unit and the maintaining and recovering unit together as a single unit, the engaging unit being disposed at a position lower than a first position where the page-width inkjet head unit is first in contact with the cap unit when the page-width inkjet head unit is lowered.

6. The image forming apparatus according to claim 1, wherein the page-width inkjet head unit is horizontally movably disposed so as to move between an image forming position for forming an image and an evacuating position separated from the image forming position; and the page-width inkjet head unit includes an engaging unit for engaging the page-width inkjet head unit and the maintaining and recovering unit together as a single unit when the page-width inkjet head unit is in the evacuating position.

7. The image forming apparatus according to claim 1, further comprising:

a fluid tank for storing fluid to be supplied to the page-width inkjet head unit; and an open/close valve disposed in the page-width inkjet head unit for opening/closing a fluid supply channel between the fluid tank and the page-width inkjet head unit, wherein the open/close valve is closed when the page-width inkjet head unit is separated from the apparatus main body.

8. The image forming apparatus according to claim 1, wherein the page-width inkjet head unit is a page-width inkjet head unit structure including a head capable of ejecting the fluid droplets of plural colors;

the page-width inkjet head unit structure is horizontally movably disposed so as to move between an image forming position for forming an image and an evacuating position separated from the image forming position; and the maintaining and recovering unit faces the page-width inkjet head unit structure when the page-width inkjet head unit structure is in the evacuating position.

9. The image forming apparatus according to claim 8, further comprising:

a rotation axle, wherein the page-width inkjet head unit structure includes a head supporting section mounted on the rotation axle, and a head section removably mounted on the head supporting section.

10. The image forming apparatus according to claim 9, wherein the head section and the head supporting section each have a first connector section enabling the connection and disconnection of a fluid supply channel between the page-width inkjet head unit section and the head supporting section.

11. The image forming apparatus according to claim 10, wherein the first connector section includes a valve mechanism for opening and closing the fluid supply channel.

12. The image forming apparatus according to claim 9, wherein the head section and the head supporting section each have a second connector section enabling the connection and disconnection of an electrical signal transmission channel between the head section and the head supporting section.

13. The image forming apparatus according to claim 9, wherein the head section and the head supporting section each have a positioning unit for determining the positional relationship between the head section and the head supporting section.

14. The image forming apparatus according to claim 9, wherein the head section includes a handle attached thereon.

15. The image forming apparatus according to claim 9, wherein the evacuating position of the page-width inkjet head unit structure is located on the front side of the apparatus main body.

16. The image forming apparatus according to claim 9, further comprising:

a conveying belt structure including a conveying belt for conveying the recording medium; wherein the page-width inkjet head unit structure is rotatably mounted on the rotation axle; and either the maintaining and recovering unit or the conveying belt structure is positioned relative to and is mounted on the rotation axle.

17. The image forming apparatus according to claim 9, further comprising:

a height adjusting unit for adjusting the height of the page-width inkjet head unit structure.

18. The image forming apparatus according to claim 9, further comprising:

a conveying unit for conveying the recording medium;

an interval determining unit for determining an interval between the page-width inkjet head unit structure and the conveying unit; and a height determining unit for determining the height of the maintaining and recovering unit and the page-width inkjet head unit structure when the page-width inkjet head unit structure is in waiting or maintenance and recovery operations.

19. The image forming apparatus according to claim 9, further comprising:

a first positioning unit for positioning the head section so that the longitudinal direction of the head section is substantially orthogonal to a conveying direction of the recording medium; and a second positioning unit for positioning the head section relative to the maintaining and recovering unit.

20. The image forming apparatus according to claim 9, further comprising:

first detecting units disposed one on each of upstream and downstream sides relative to the page-width inkjet head unit structure in a conveying direction of the recording medium; and second detecting units for determining whether the page-width inkjet head unit structure is in the image forming position or the evacuating position.

* * * * *